US010634297B2

(12) United States Patent
Romano et al.

(10) Patent No.: US 10,634,297 B2
(45) Date of Patent: Apr. 28, 2020

(54) LIGHTING FIXTURE

(71) Applicant: Hubbell Incorporated, Shelton, CT (US)

(72) Inventors: Perry Romano, Bradenton, FL (US); Adam J. Clark, Bradenton, FL (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/964,578

(22) Filed: Apr. 27, 2018

(65) Prior Publication Data

US 2018/0320837 A1 Nov. 8, 2018

Related U.S. Application Data

(60) Provisional application No. 62/613,959, filed on Jan. 5, 2018, provisional application No. 62/501,959, filed on May 5, 2017.

(51) Int. Cl.

| | |
|---|---|
| ***F21S 2/00*** | (2016.01) |
| ***F21V 29/74*** | (2015.01) |
| ***F21V 21/30*** | (2006.01) |
| ***F21V 17/00*** | (2006.01) |
| ***F21V 23/00*** | (2015.01) |
| ***F21V 29/76*** | (2015.01) |
| ***F21V 3/06*** | (2018.01) |
| ***F21Y 115/10*** | (2016.01) |
| ***F21W 131/105*** | (2006.01) |
| ***F21S 8/08*** | (2006.01) |
| ***F21W 131/407*** | (2006.01) |
| ***F21Y 105/12*** | (2016.01) |

(Continued)

(52) U.S. Cl.

CPC ..... *F21S 2/005* (2013.01); *F21V 3/0625* (2018.02); *F21V 17/002* (2013.01); *F21V 21/30* (2013.01); *F21V 23/007* (2013.01); *F21V 29/74* (2015.01); *F21V 29/763* (2015.01); *F21S 8/08* (2013.01); *F21V 5/007* (2013.01); *F21W 2131/105* (2013.01); *F21W 2131/407* (2013.01); *F21Y 2105/12* (2016.08); *F21Y 2113/13* (2016.08); *F21Y 2115/10* (2016.08)

(58) Field of Classification Search

CPC ..... F21S 2/005; F21V 23/0435

See application file for complete search history.

(56) References Cited

U.S. PATENT DOCUMENTS 5,599,091 A 2/1997 Kira
5,938,324 A 8/1999 Salmon et al.

(Continued)

OTHER PUBLICATIONS

Sievers, "Fundamentals of LED Light Pipes," Electronic Design 2013, Retrieved from the Internet https://www.electronicdesign.com/components/fundamentals-led-light-pipes, May 8, 2013, 7 pages.

(Continued)

*Primary Examiner* — William N Harris

(74) *Attorney, Agent, or Firm* — Dority & Manning, PA

(57) ABSTRACT

A lighting fixture can include a housing and a plurality of modules positioned within the housing. The plurality of modules can be distributed along a front portion of the housing. Each module of the plurality of modules includes a plurality of light emitting diodes and is independently mountable in the housing such that a number of modules in the plurality of modules is selectable.

17 Claims, 17 Drawing Sheets

(51) Int. Cl.
*F21V 5/00* (2018.01)
*F21Y 113/13* (2016.01)

(56) References Cited

U.S. PATENT DOCUMENTS

| | | | | |
|---|---|---|---|---|
| 5,988,842 | A | 11/1999 | Johnsen et al. | |
| 6,779,907 | B2 | 8/2004 | Beadle | |
| 6,942,363 | B1 | 9/2005 | LeVasseur | |
| 7,182,486 | B1 | 2/2007 | Miracle | |
| 8,585,250 | B1 * | 11/2013 | Kim | F21V 15/011 362/294 |
| 9,115,857 | B2 | 8/2015 | Beausoleil | |
| 9,995,439 | B1 | 6/2018 | Shum | |
| 10,036,534 | B2 * | 7/2018 | Morello | F21V 13/02 |
| 10,228,098 | B2 * | 3/2019 | Berkeljon | F21K 9/00 |
| 10,386,057 | B2 * | 8/2019 | Harvey | F21V 29/78 |
| 2012/0155080 | A1 | 6/2012 | Schupple et al. | |
| 2012/0206918 | A1 * | 8/2012 | Lee | F21S 2/005 362/249.02 |
| 2013/0176707 | A1 * | 7/2013 | Audette | F21V 29/20 362/84 |
| 2013/0329409 | A1 | 12/2013 | Windom et al. | |
| 2014/0168991 | A1 * | 6/2014 | Kim | F21V 15/013 362/297 |
| 2014/0210357 | A1 | 7/2014 | Yan et al. | |
| 2014/0293603 | A1 | 10/2014 | Barnard et al. | |
| 2015/0167931 | A1 | 6/2015 | Borgarelli | |
| 2016/0047538 | A1 * | 2/2016 | Peck | F21S 2/005 362/249.02 |
| 2016/0319996 | A1 | 11/2016 | Moon | |
| 2017/0184288 | A1 * | 6/2017 | Owens | F21V 21/15 |
| 2018/0224111 | A1 * | 8/2018 | Emerson | F21V 29/58 |
| 2018/0340683 | A1 * | 11/2018 | Harvey | F21L 4/00 |
| 2019/0086047 | A1 * | 3/2019 | Jiang | F21V 29/56 |
| 2019/0120445 | A1 * | 4/2019 | Casper | F21S 2/005 |
| 2019/0195485 | A1 * | 6/2019 | Harvey | F21V 29/83 |

OTHER PUBLICATIONS

PCT International Search Report and Written Opinion for corresponding PCT Application No. PCT/US2018/029775, dated Sep. 17, 2018, 11 pages.

PCT International Preliminary Report on Patentability for corresponding PCT Application No. PCT/US2018/029775, dated Nov. 5, 2019—8 pages.

* cited by examiner

LIGHTING FIXTURE

REFERENCE TO RELATED APPLICATION

This application claims priority to U.S. Provisional Application No. 62/501,959, filed on May 5, 2017, titled "LIGHTING FIXTURE," which is incorporated herein by reference. This application also claims priority to U.S. Provisional Application No. 62/613,959, filed on Jan. 5, 2018, titled "REDUCED GLARE LIGHT FIXTURE," which is incorporated herein by reference.

FIELD

The present disclosure relates generally to lighting fixtures, such as lighting fixtures for athletic fields.

BACKGROUND

In recent years, lighting fixtures (e.g., luminaires) with light emitting diodes (LEDs) have become more practical, and LED lighting fixtures continue to penetrate the lighting market due to the increased luminous efficacy of commercially available LED components relative to other light sources. LED luminaires are desirable as they offer customers energy savings due to good luminous efficacy combined with the ability to precisely control light distribution patterns, which is of particular importance for certain lighting scenarios, e.g., open outdoor environments, such as athletic fields. Electrical components for powering and controlling LED luminaires are typically contained within an associated housing. During operation, heat is often produced by the electrical components that may be detrimental to the function of the lighting fixture.

Additionally, lighting fixtures with LEDs can be used to provide artificial lighting for many different applications. For instance, lighting fixtures with LEDs can provide artificial lighting for many different sporting competitions and sporting venues. While artificial lighting often allows participation in indoor sports, and outdoor sports in darkened conditions, artificial lighting is not without drawbacks. Glare is currently one of the biggest complaints about sports lighting. The problem of glare is not limited to sporting venues either. For example, flood lighting used around various structures and airport ramp lighting are often the subject of complaints about glare.

Glare and related light trespass area of special concern when installing floodlights. Disability glare reduces visual performance and visibility. Discomfort glare produces physical discomfort. It is possible to experience disability without discomfort, and conversely, discomfort without disability, however, one often accompanies the other. Regarding light that we actually see, brightness can be measured as the light leaving a lamp, or the light reflecting from an object's surface. It is measured in footlamberts (English) or candelas/square meter (metric). In practice, glare is usually a situation where a source of unshielded light is at least 1,000 times brighter than the average visual field. For instance, because the night sky is dark, almost all outdoor light sources, such as a street luminaire or automobile headlight, cause glare. To evaluate glare, however, one may use luminance, which typically is measured in candelas per square meter (cd/m2) or nits.

As used herein, the term glare includes all forms of glare, including discomfort glare and disability glare, as well as light trespass, and related stray light problems. For example, ocular stray light is a phenomenon where parts of the human eye scatter light that reaches the retina, but do not contribute to forming a correct image.

One approach to reducing glare is decrease light intensity of the artificial light source. However, if the decreased light intensity cannot be offset with additional lighting fixtures, overall lighting may drop below acceptable levels. Even if decreased light intensity is offset with additional lighting fixtures, such additional lighting fixtures typically incur a corresponding increase in costs.

Another approach to reducing glare is to use louvers, such as various types of blade and concentric louvers. Unfortunately, louvers have the effect of reducing light output and correspondingly increasing costs to compensate for the loss of light by producing additional lumens of light to offset the losses.

SUMMARY

Aspects and advantages of embodiments of the present disclosure will be set forth in part in the following description, or may be learned from the description, or may be learned through practice of the embodiments.

The present subject matter provides a lighting fixture. In one example aspect of the present disclosure, the lighting fixture includes a housing and a plurality of modules. Each module of the plurality of modules is mountable within the housing and includes a plurality of LEDs. Depending upon the desired lighting scenario, the number and/or arrangement of modules within the housing may be modified. The modules may be distributed along a circumferential direction at a front portion of the housing. Each module may be independently mountable in the housing such that a number of modules is selectable.

Other example aspects of the present disclosure are directed to lighting systems, light engines, lighting circuits, lighting fixtures, devices, methods, and apparatuses according to example aspects of the present disclosure.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

DETAILED DESCRIPTION

Figure 1:
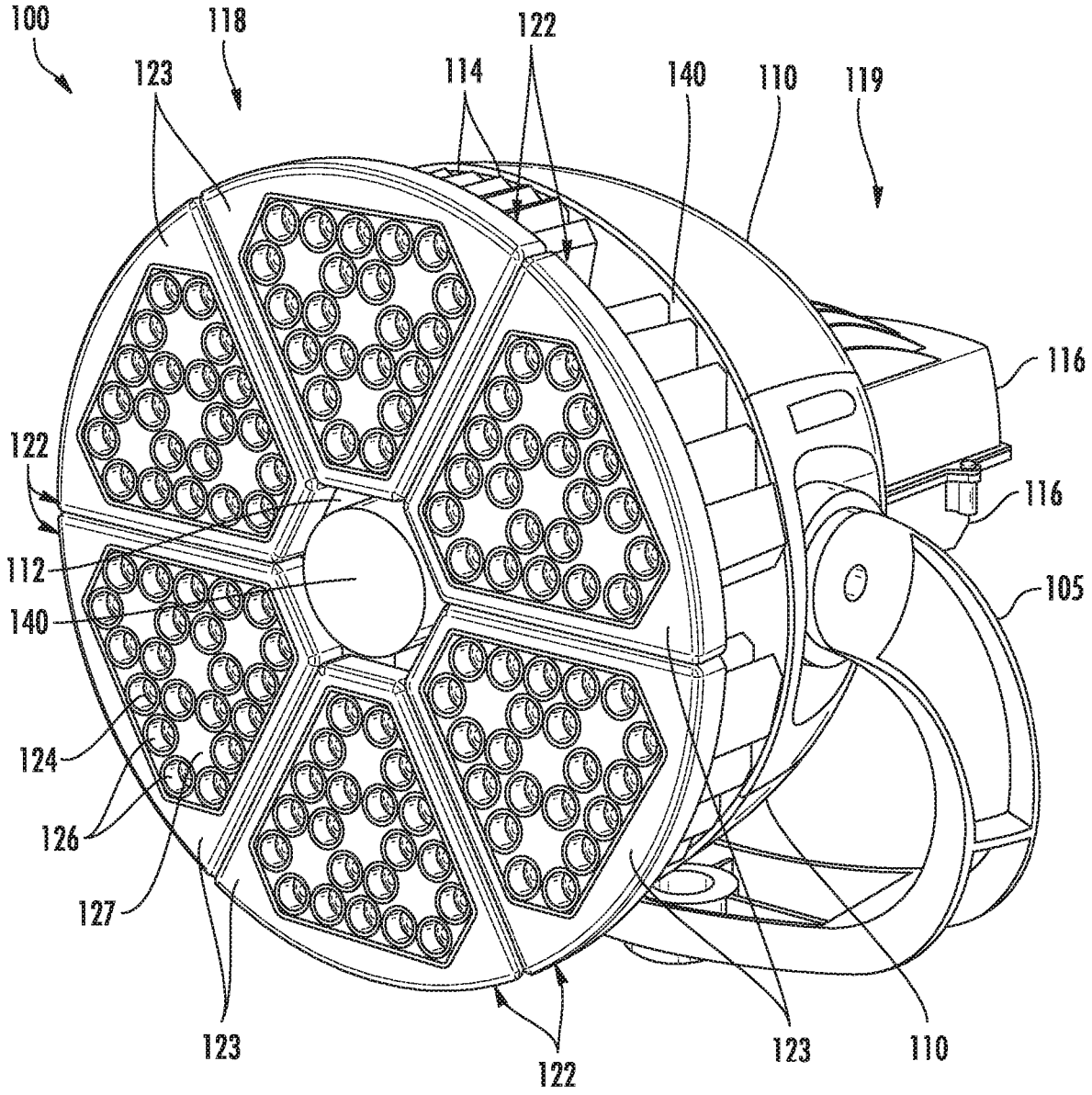
FIG. 1 depicts a front, perspective view of a lighting fixture according to example embodiments of the present disclosure.
Figure 2:
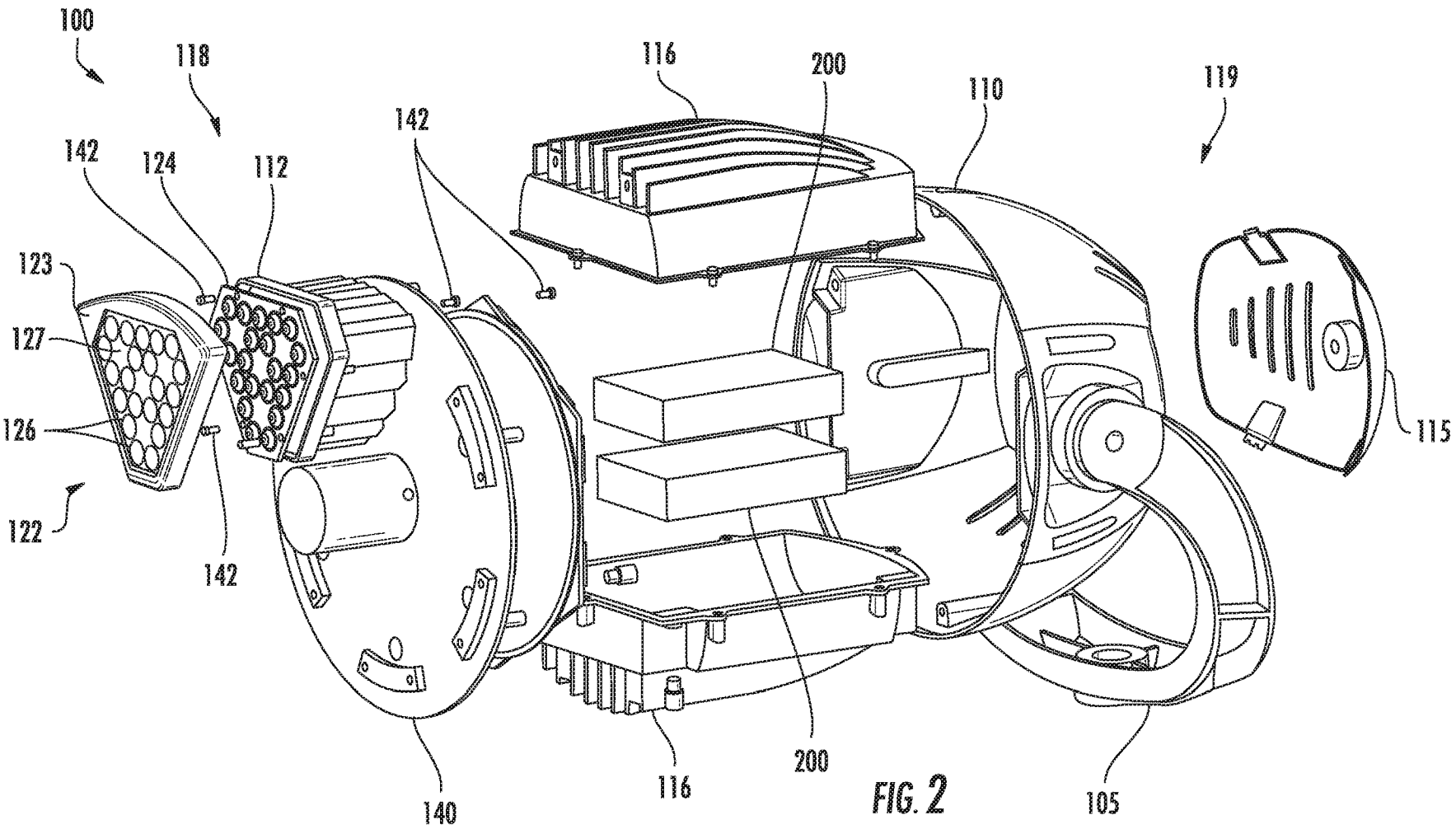
FIG. 2 depicts an exploded, perspective view of an example lighting fixture according to example embodiments of the present disclosure.
Figure 3:
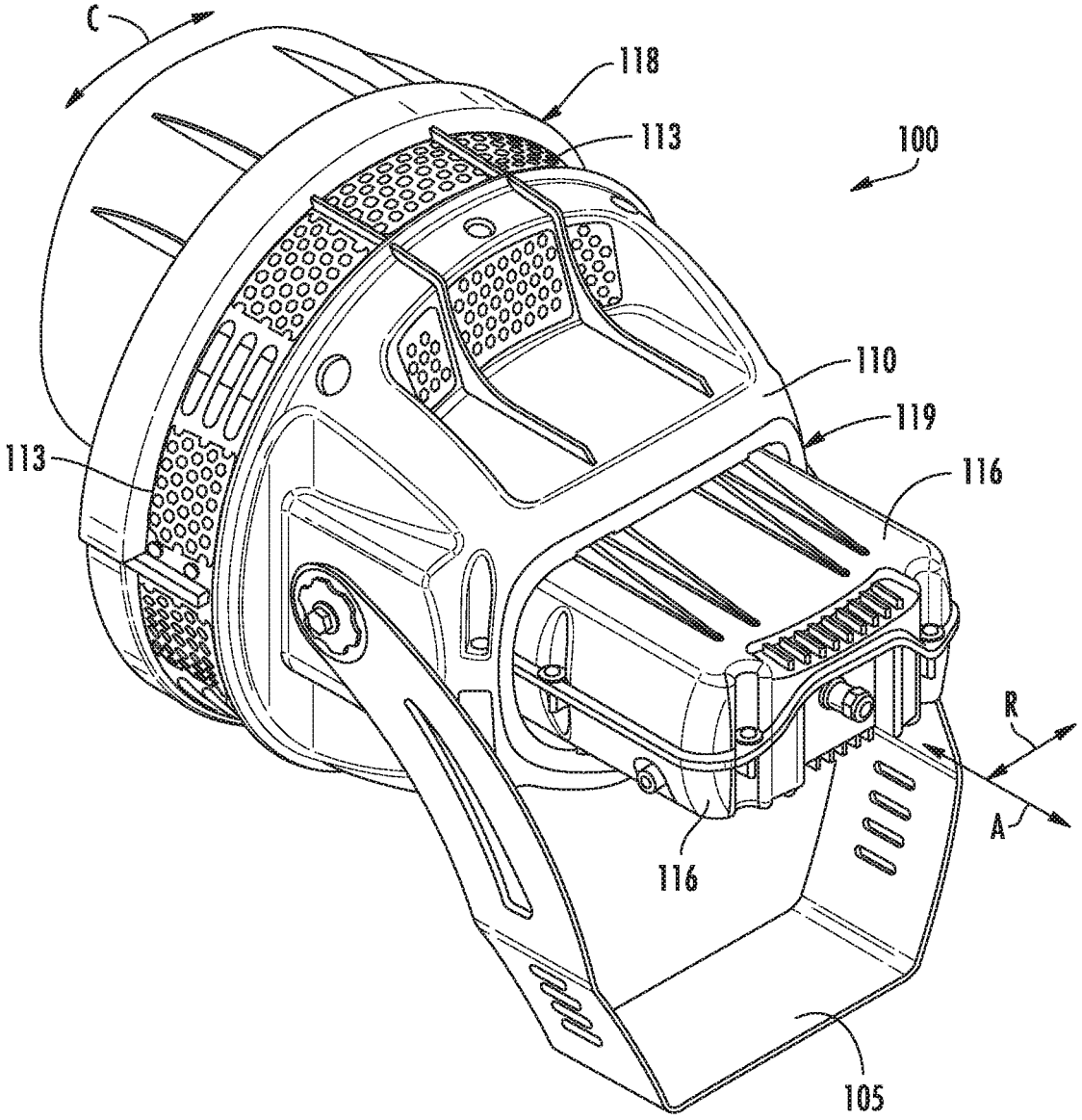
FIG. 3 depicts a rear, perspective view of a lighting fixture according to example embodiments of the present disclosure.
Figure 4:
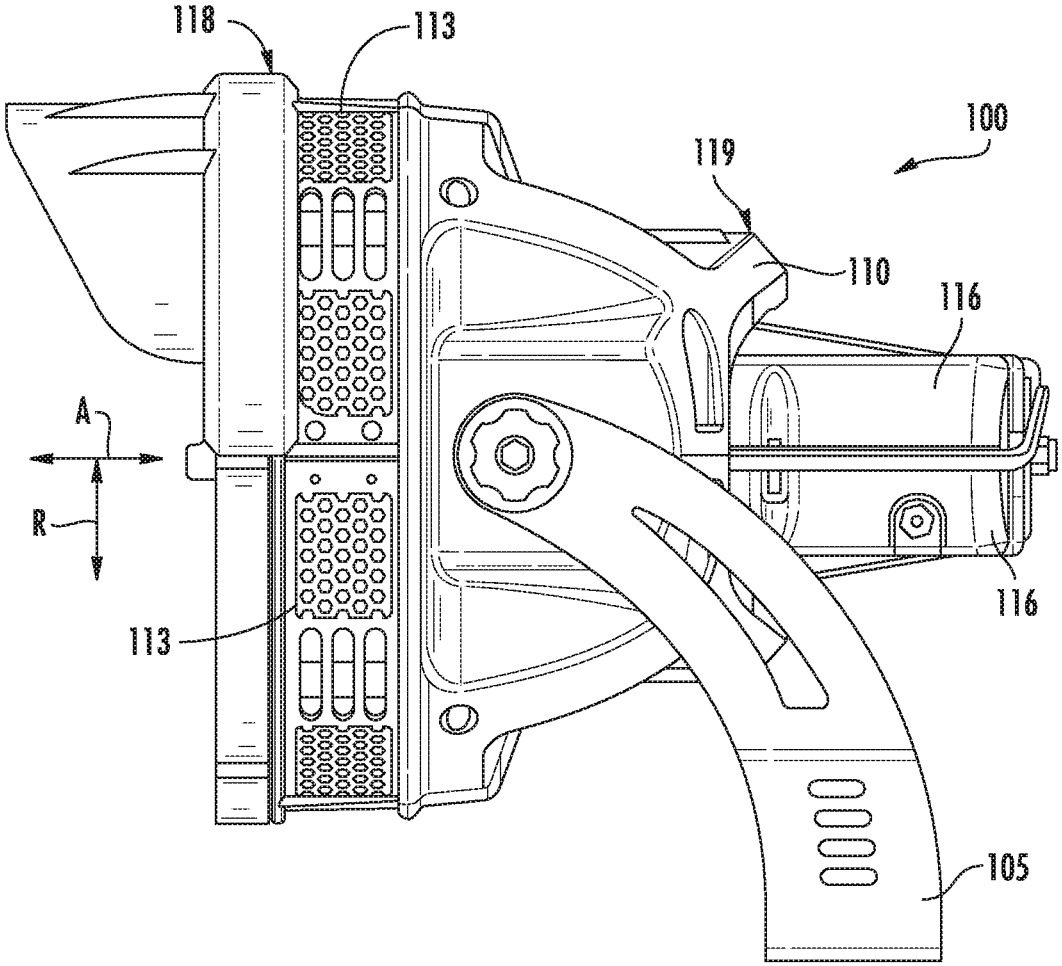
FIG. 4 depicts a side, elevation view of the example lighting fixture.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to lighting fixtures with LED modules. As one example, the lighting fixture may be configured to accommodate various numbers of LED modules within a housing depending upon the desired lighting scenario. Thus, e.g., the lighting fixture may be equipped with a greater number of LED modules in certain lighting scenarios, and the lighting fixture may be equipped with a lesser number of LED modules in other lighting scenarios. The lighting fixtures may include various features to facilitate mounting a desired number of LED modules within the housing.

In some embodiments, a lighting fixture may include a housing and a plurality of modules. The plurality of modules may be positioned within the housing, and each module of the plurality of modules may include a plurality of light emitting diodes. The plurality of modules may be distributed along a circumferential direction at a front portion of the housing. Each module of the plurality of modules may be independently mountable and/or removable in the housing. By being independently mountable and/or removable within the housing, a number of modules in the plurality of modules may be selectable, e.g., by a manufacturer or user of the lighting fixture. Thus, the number of modules may be selected to suit a particular lighting scenario.

According to particular aspects of the present disclosure, the plurality of modules may include no less than two modules and no greater than twelve modules. Thus, e.g., the number of modules within the housing may vary between two and twelve modules depending upon the particular lighting scenario. As a particular example, the housing may be sized for receiving exactly six modules. Thus, e.g., the number of modules within the housing may vary between two and six modules depending upon the particular lighting scenario.

Each module of the plurality of modules may have a common shape. When the modules of the plurality of modules have a common shape, the plurality of modules may be interchangeable with one another and/or manufactured with the same process. As a particular example, each module of the plurality of modules may include a heat sink, and all heat sinks of the plurality of modules may be commonly shaped and/or sized. Thus, e.g., the heat sinks may all be formed with a common casting process, e.g., with a single mold.

In some embodiments, each module of the plurality of modules has an inner edge and an outer edge. The inner and outer edges of each module may be spaced along a radial direction. The inner edge of each module may be positioned proximate a central axis of the housing. A width of each module of the plurality of modules along the circumferential direction may taper from the outer edge to the inner edge. Each module of the plurality of modules may also have a pair of opposing side edges that extend along the radial direction between the inner edge and the outer edge. The pair of opposing side edges may define an angle, and the angle between the pair of opposing side edges may be no greater than one hundred and twenty degrees and no less than thirty degrees. Thus, e.g., each module of the plurality of modules may be wedge shaped. When the modules are wedge shaped, the distribution of the plurality of modules at the front portion of the housing may be arcuate and/or circular.

According to particular aspects of the present disclosure, a support plate or body may be positioned within the housing. Each module of the plurality of modules may be mounted to the support body. For example, each module of the plurality of modules may include a heat sink with a plurality of fins that extend away from the front portion of the housing. The heat sink of each module may be mounted to the support body. In certain exemplary embodiments, the heat sink of each module of the plurality of modules may be fastened to the support body. The support body may provide a convenient layout or guide for mounting the plurality of modules. Thus, each module of the plurality of modules may be mounted at a respective location on the support body, and the support body may assist with providing suitable spacing and/or orientation between adjacent modules on the support body. The support body may facilitate mounting of the selected number of modules within the housing by providing a single structure on which all the modules may be mounted.

In certain embodiments, the fins on each heat sink are all vertically oriented. With the fins all vertically oriented, a plurality of vertical air flow paths may be defined within the heat sinks of the plurality of modules. Vertical air flow paths may facilitate cooling air flow through the heat sinks. For example, heated air may flow upwardly along the vertical air flow paths between the fins. As the heated air flows upwardly, cooler air may be drawn into the vertical air flow paths. Thus, vertically orienting all of the fins may assist with improving cooling convection air flow through the heat sinks. To further facilitate cooling air flow, the housing may include a grill that extends around the heat sinks of the plurality of modules along the circumferential direction. The grill may be perforated such that air may flow through the housing at the grill to and/or from the heat sinks of the plurality of modules. More specifically, in some embodiments, cooler air may flow through the grill into the housing below the heat sinks, and warmer air may flow through the grill out of the housing above the heat sinks. In such a manner, the grill may facilitate cooling air flow through the heat sinks of the plurality of modules within the housing.

The LEDs on the module may be operated by one or more drivers. The one or more drivers may be integrated within the housing of the lighting fixture in certain embodiments. In other embodiments, the one or more drivers may be located remote from or external to the housing. When the one or more drivers are integrated within the housing, the housing may include a driver casing positioned at a rear portion of the housing, and the one or more divers may be positioned within the driver casing and operatively coupled to the plurality of modules. The driver casing may be a removable driver casing. Thus, the driver casing may be removed from the remainder of the housing, e.g., when the one or more drivers are located remote from or external to the housing.

In certain embodiments, the lighting fixture may include at least one spacer module or plug. The at least one plug and the plurality of modules may be distributed along the circumferential direction at the front portion of the housing. Thus, the at least one plug and the plurality of modules may cooperate to collectively form a face of lighting fixture. For example, the at least one plug and the plurality of modules may collectively extend three hundred and sixty degrees along the circumferential direction at the front portion of the housing. The at least one plug and the plurality of modules may be interchangeable within the housing. In such a manner, each space left by an omitted module may be filled with a respective one of the at least one plug.

The lighting fixture may further include an electronic module. The electronic module may be positioned on the central axis of the housing at the front portion of the housing. The electronic module may be connected to or include one or more of a wireless communication module and a laser direction module. The wireless communication module may assist with remotely controlling operation of the lighting fixture. The laser direction module may be operable to emit a laser beam that assists with orienting the lighting fixture towards a desired location.

Another example aspect of the present disclosure is directed to a lighting fixture. The lighting fixture can include a plurality of light engine modules. Each light engine module can include a bezel and at least one light emitting source. The bezel can include at least one glare reduction tube configured to be approximately coaxial with the at least one light emitting source. In some embodiments, the bezel can be formed from a translucent material. More specifically, the translucent material can be selected from an acrylic compound and polycarbonate. In some embodiments, the bezel can be formed with an opaque material or coated with an opaque material. Alternatively, the bezel can be coated with an opaque material.

In some embodiments, each light engine module includes an optic configured to optically couple the at least one light emitting source and the at least one glare reduction tube. Alternatively or additionally, each light engine module can include a heat sink comprising a plurality of fins. In some embodiments, the at least one light emitting source can be mounted on a printed circuit board that is positioned between the bezel and the heat sink.

In some embodiments, the lighting fixture includes a bezel comprising a surface and at least one glare reduction tube extending from the surface. More specifically, the surface can be comprised of a translucent material or an opaque material. In some embodiments, the at least one glare reduction tube comprises a plurality of glare reduction tubes. Additionally, the bezel can be positioned over a plurality of light emitting sources. In this manner, the plurality of glare reduction tubes extending from the surface can be aligned with one light emitting source of the plurality of light emitting sources.

As used herein, a "lighting fixture" or "luminaire" refers to a device used to provide light or illumination using one or more light sources. The use of the term "about" when used in conjunction with a numerical value is intended to refer to within twenty five percent (25%) of the stated numerical value.

FIGS. 1 through 5 depict a lighting fixture 100 according to an example embodiment of the present disclosure. The lighting fixture 100 can be, for instance, an area or flood lighting fixture configured to provide lighting for a space, such as an athletic field, a stadium, etc. The lighting fixture 100 can be mounted to a pole, wall, or other structure using a plurality of different mounting options. For instance, as shown in FIGS. 1 through 5, the lighting fixture 100 can include a mounting yoke or bracket 105 for mounting to a horizontal arm. Alternatively, the lighting fixture 100 can be mounted, for instance, using a pole, wall, vertical tenon, or traditional arm mounting. Mounting options can also include use of a wall bracket, adjustable knuckle, outer diameter slip fit arm mount, rectangular arm, etc.

As shown, the lighting fixture 100 includes a housing 110 configured to contain and/or cover various components of the lighting fixture 100, such as electrical components, conductors, etc. The housing 110 can be made from a suitable material such as such as plastic, aluminum, die cast aluminum, stainless steel, galvanized steel, powder coated steel, or other material. In certain example embodiments, the housing 110 may be a plastic shell that covers internal components of the lighting fixture 100. It will be understood that the lighting fixture 100 may omit the housing 110 in certain example embodiments, e.g., such that the internal components of the lighting fixture 100 are enclosed within a plastic shell. In other example embodiments, the housing 110 can be in conductive thermal communication electrical components and light sources (e.g., LED devices) associated with the lighting fixture 100. Thus, the housing 110 can act as a thermal heat sink for heat generated by the electrical components and light sources (e.g., LED devices) associated with the lighting fixture 100 by conducting heat away from heat generating sources within the housing 110 to the ambient atmosphere around the housing 110.

The lighting fixture 100 also includes an LED system 120. The LED system 120 includes a plurality of light engine modules 122. Thus, the LED system 120 may be a module LED system. Each module 122 includes a plurality of LED devices 125 mounted on a printed circuit board (PCB) or LED board. LED devices 125 can be configured to emit light as a result of movement of electrons through a semiconductor material. LED devices 125 can be of any suitable size, color, color temperature, etc. for the desired light applications. For instance, LED devices 125 can have a color temperature of 3000K, 4000K, 5000K or other suitable color temperature.

Example aspects of the present disclosure are discussed with LED light sources for purposes of illustration and discussion. However, those of ordinary skill in the art, using the disclosures provided herein, will understand that other suitable light sources (e.g., other solid state light sources, fluorescent light sources, etc.) can be used without deviating from the scope of the present disclosure.

Turning to FIGS. 8 through 12, an optic 124 (e.g., a lens) can be positioned over each LED device 125. Optics 124 and/or arrangement of LED devices 125 can be configured to provide a variety of different light distributions, such as a type I distribution, type II distribution, type III distribution, type IV distribution, type V distribution (e.g., round, square, round wide, etc.), other light distribution, or combination of light distributions. As a particular example, optics 124 and/or arrangement of LED devices 125 can be configured to provide flood optics, such as a 2×2 beam pattern, a 3×3 beam pattern, a 4×4 beam pattern, a 5×5 beam, pattern, and a 6×6 beam pattern. LED devices 125 on each module 122 may have a respective light distribution, in certain exemplary embodiments. Optics 124 may be connected or formed together on a plate, e.g., such that optics 124 are formed from one piece of material.

A gasket (e.g., a polyurethane or silicone gasket) can be placed around or over the optics 124 to weatherproof module 122. For example, the gasket may also be provided around a perimeter of the plate that connects optics 124, and the gasket may be a silicone sponge cord formed as a continuous loop that is inserted into a groove molded into the plate. In some implementations, the lighting fixture 100 can include alignment pins that can be integral to the optics 124 and fit into holes on the LED board to aid lateral and traverse alignment of the optics 124. In some implementations, lighting fixture 100 can include a one-piece bezel 123 with integral molded-in optical elements and/or a plastic bezel 123 with optics adhered (and/or sonically welded) to the bezel 123. Each module 122 of LED system 120 is mountable within or on the housing 110 to provide a light source for the lighting fixture 100, as discussed in greater detail below.

In some embodiments, the bezel 123 can include a plurality of glare reduction tubes 126 are integrally formed with the bezel 123. More specifically, each glare reduction tube of the plurality of glare reduction tubes 126 is hollow and enables light to pass from one optic 124 and one LED device 125. In some embodiments, the plurality of glare reduction tubes 126 are integrally formed with the bezel 123. For instance, the plurality of glare reduction tubes 126 and the bezel 123 can be formed as a single monolithic component. Alternatively, the plurality of glare reduction tubes 126 and the bezel 123 can be formed as separate components. In this manner, the plurality of glare reduction tubes 126 can be removably coupled to the bezel 123.

Figure 9:
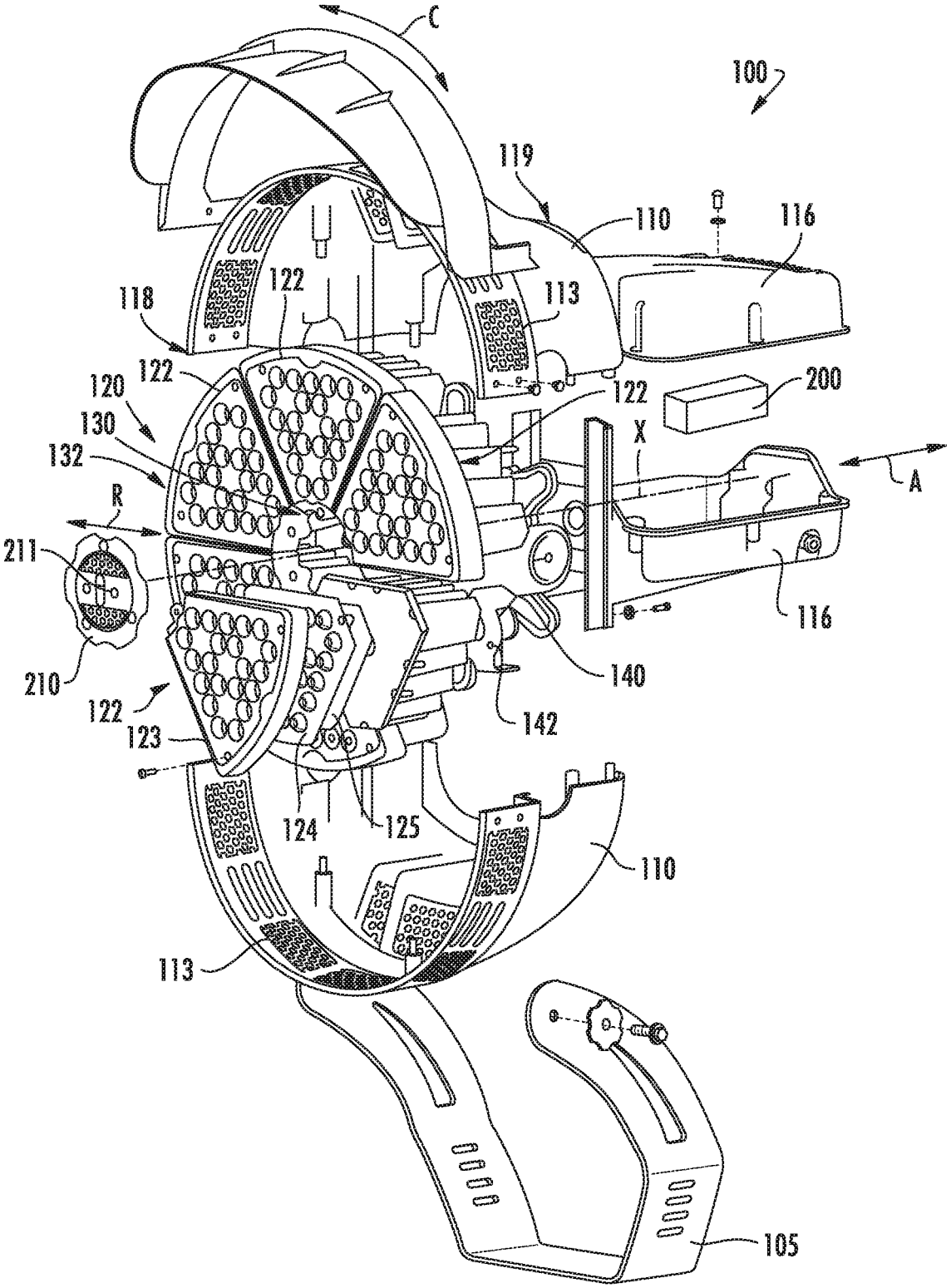
FIG. 9 depicts a front, exploded view of the example lighting fixture.
Figure 10:
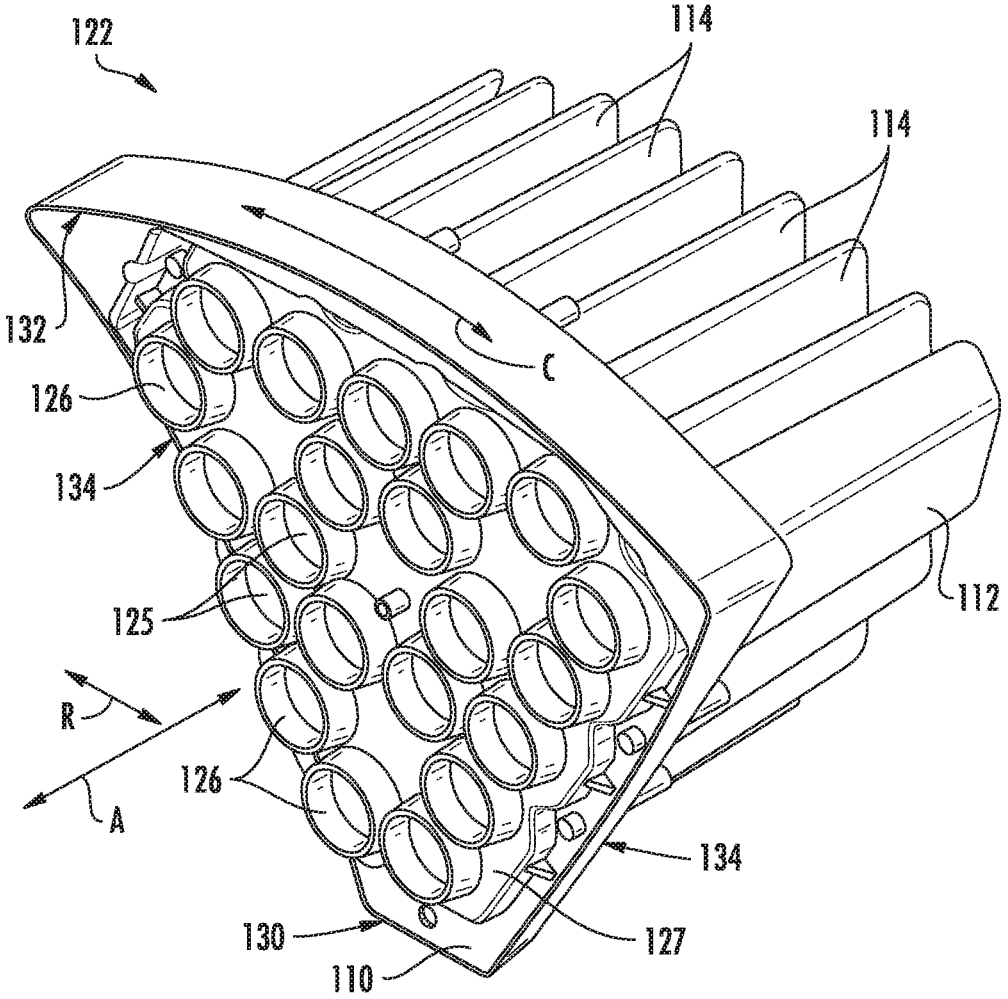
FIG. 10 depicts a front, perspective view of a module of the example lighting fixture of FIG. 3.
Figure 11:
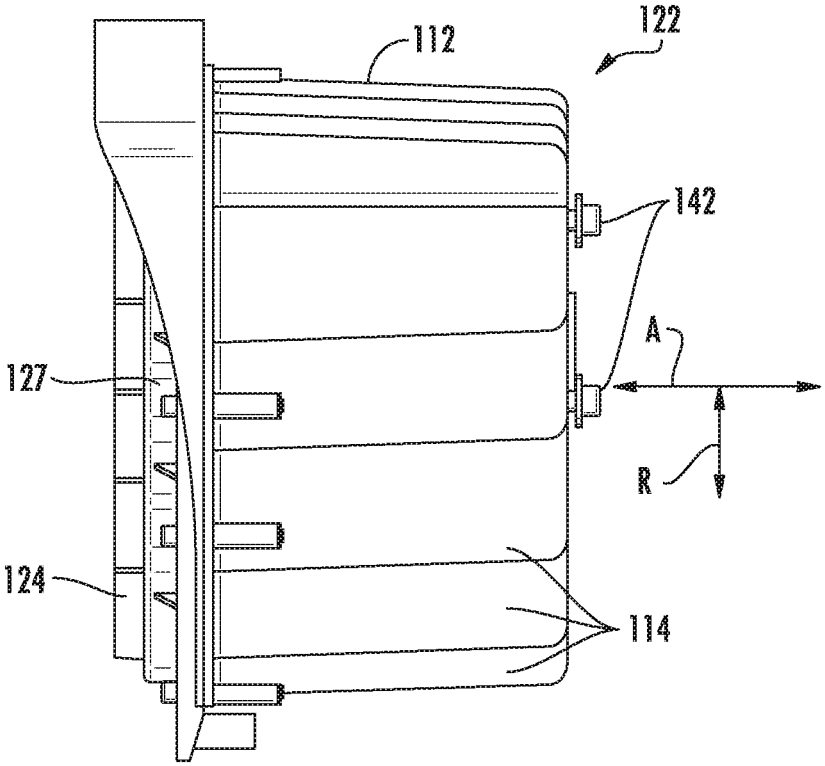
FIG. 11 depicts a side, elevation view of the module of FIG. 10.
Figure 12:
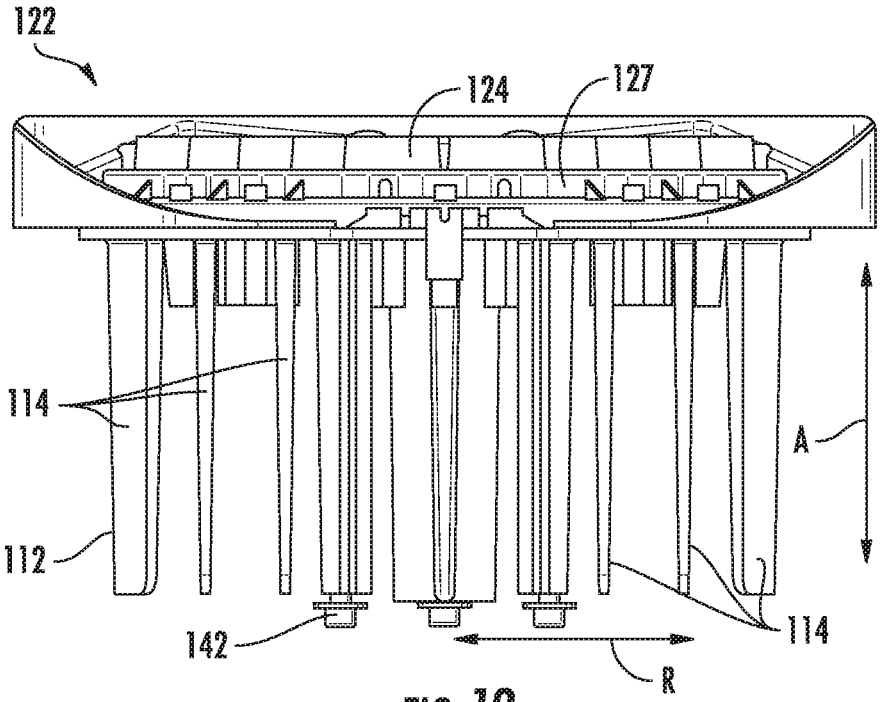
FIG. 12 depicts a bottom, plan view of the module of FIG. 10.

As shown in FIG. 10, the bezel 123 (FIG. 9) includes a surface 127. In some embodiments, the surface 127 can be a base of the bezel 123. The plurality of glare reduction tubes 126 can be associated with the surface 127 of the bezel 123. For example, the plurality of glare reduction tubes 126 can extend from the surface 127. Alternatively, the plurality of glare reduction tubes 126 can extend through the surface 127. In some embodiments, the surface 127 of the bezel 123 can be comprised of opaque material. Alternatively, the surface 127 of the bezel 123 can be comprised of translucent material. In some embodiments, the surface 127 of the bezel 123 can be positioned over a plurality of light emitting sources (e.g., LED devices) such that each glare reduction tube 126 is aligned with one light emitting source of the plurality of light emitting sources.

In some embodiments, each optic 124 and LED device 125 are recessed approximately 0.8 inches within each glare reduction tube 126. In general, in some embodiments, the depth of the recess is a variable dependent on the width of the light beam spread. For example, a more narrow light beam has a deeper recess than a wider light beam. In some embodiments, to reduce glare, the bezel 123, including each glare reduction tube of the plurality of glare reduction tubes 126 in the bezel 123, are formed from a translucent material that diffuses light from the LED devices. In some embodiments, the bezel 123 is formed from a material selected from an acrylic compound and polycarbonate. Some light from the LED devices passes through and is diffused by the translucent material in the bezel 123 before being emitted by the lighting fixture 100. It has been discovered that, under certain conditions, observers viewing the lighting fixture 100 from some angles offset to an outward axial direction A, i.e., the normal axis for the lighting fixture 100, report a significant reduction in glare from the lighting fixture 100 as opposed to comparable lighting fixtures without the bezel 123. Note that the outward axial direction A is generally in the direction from the rear portion 119 to the front portion 118. One possible explanation for the apparent reduction in glare is thought to be due to smoothing contrast between light from the LED devices passing through each of the glare reduction tubes 126 effectively reduces glare for an observer at certain distances and angles.

In some embodiments, to reduce glare, the bezel 123, including each of the plurality of glare reduction tubes 126 in the bezel 123, are formed from an opaque material that blocks light from the LED devices 125. More specifically, in some embodiments, the opaque material is black. In this manner, the bezel 123 can block light emitted from the LED devices 125 before said light can be emitted by the lighting fixture 100. It has been discovered that, under certain conditions, observers viewing the lighting fixture 100 from some angles offset to axial direction A, i.e., the normal axis for the lighting fixture 100, report a significant reduction in glare from the lighting fixture as opposed to comparable lighting fixtures without the bezel 123. It is thought that the reduction of light emitted at angles offset to the axial direction A passing through the glare reduction tubes 126 from the LED devices 125 reduces glare for an observer.

Figure 16:
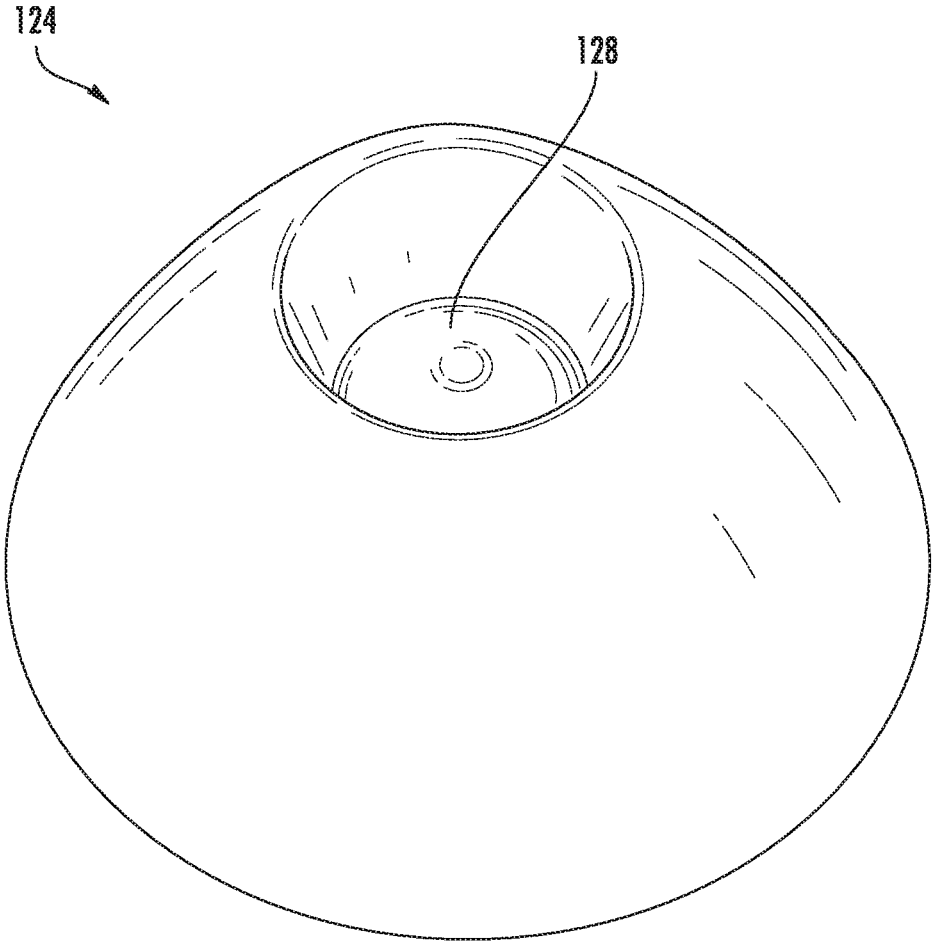
FIG. 16 is a rear, perspective view of an optic of the example lighting fixture according to example embodiments of the present disclosure.

In some embodiments, each optic 124 in the lighting fixture 100 is optically coupled with one of the plurality of LED devices 125. More specifically, the lighting fixture 100 can define an axial direction A, and each optic 124 can be a lens used to help direct light from the plurality of LED devices 125 in the axial direction A out of the lighting fixture 100. It should be appreciated that the optic 124 is not limited to any particular shape. Each optic 124 is positioned over one LED device 125. For example, the optic 124 shown in FIG. 16 includes a LED receptacle portion 128 for receiving one LED device of the plurality of LED devices 125.

Figure 8:
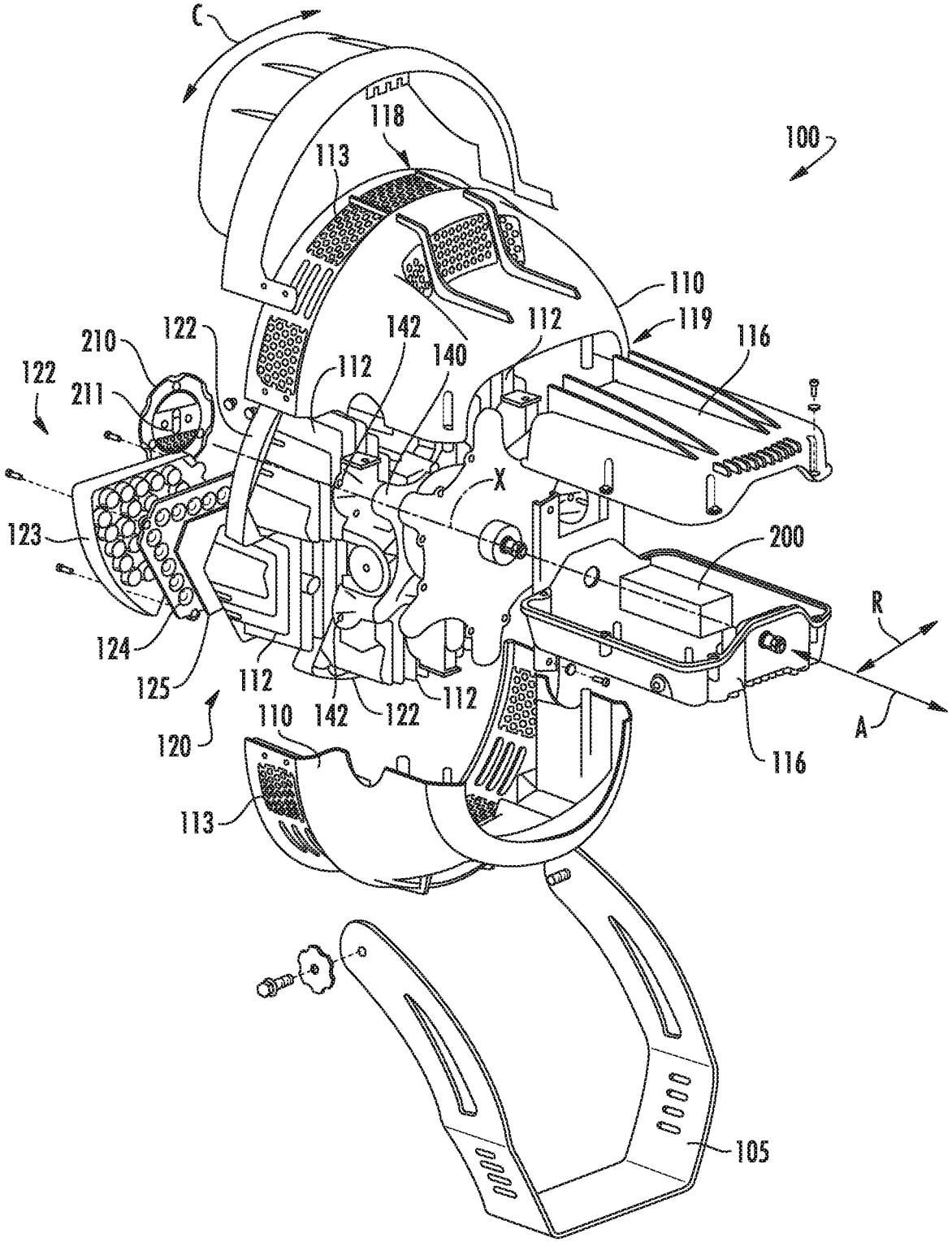
FIG. 8 depicts a rear, exploded view of the example lighting fixture.

Turning now to FIGS. 8 and 9, lighting fixture 100 can include one or more power circuits 200 (shown schematically) for providing power to energize modules 122. For instance, the power circuit(s) 200 can include surge protective device(s), transformer(s), and driver(s) for converting an AC power to a DC power for energizing the LED devices 125 located on modules 122. The power circuit(s) 200 can be configured to convert alternating current (AC) from a power source (not shown) to direct current (DC) for use by lighting fixture 100 (e.g., by modules 122). For example, the surge protector can be configured to initially receive electrical current from a power source (e.g., a power grid, battery) and to protect power circuit 200 and other electrical components of lighting fixture 100 from spikes, lightning induced surges, electrical anomalies, etc. The power circuit(s) 200 can be configured to include different types, and/or sizes of surge protector.

The surge protector of the power circuit(s) 200 can be configured in series and/or in parallel. In some implementations, the surge protector includes a mechanism to shut off fixture power when the surge protector is exhausted and can be coupled to the transformer such that the transformer receives power from the surge protector (e.g., in a series configuration). The transformer of the power circuit(s) 200 can be configured to alter the voltage for use by the driver. For example, the transformer can be a step-down transformer that can be configured to decrease the voltage of the input AC power to a voltage level suitable for the driver, e.g., about one hundred volts (100V) to about two hundred and seventy-seven volts (277V).

The driver of the power circuit(s) 200 can be configured to receive power from the transformer and energize one or more component(s) of the lighting fixture 100. The driver can be configured to convert the current from AC power to DC power. Additionally, and/or alternatively, the driver can provide constant current and/or DC power to one or more component(s) of the lighting fixture 100, such as the modules 122. In this way, the modules 122 can illuminate one or more LED devices 125 when energized by the driver. Example driver circuits can accept, for instance, an about a one hundred volt (100V) to about a two hundred and seventy-seven volt (277 V), fifty hertz (50 Hz) or sixty hertz (60 Hz) AC input or an about a three hundred and forty seven volt (347V) to four hundred and eighty volt (480V), fifty hertz (50 Hz) or sixty hertz (60 Hz) AC input. In some embodiments, the driver circuits can be dimmable driver circuits. Example driver circuits include the PLED series drivers manufactured by Thomas Research Products. Example driver circuits are also illustrated in U.S. Patent Application Publication No. 2015/0351205, attached as Appendix A, which forms a part of this disclosure.

In some embodiments, the lighting fixture 100 can include one or more control devices for controlling various aspects of lighting fixture 100. For example, lighting fixture 100 can include a wireless module 210 (FIGS. 8 and 9) coupled to modules 122 and/or power circuit 200. Wireless module 210 can be used for communicating with a remote controller (e.g., computing device) over a wireless network. Control signals can be communicated to lighting fixture 100 via wireless module 210 to control the driver(s), for instance, based on set time and date schedules that are programmed using a suitable user interface. Example aspects of wireless module 210 and example aspect of systems and methods for controlling lighting fixture 100 using, at least in part, wireless module 210 are discussed in in U.S. Patent Application Publication No. 2015/0351205, attached as Appendix A, which forms a part of this disclosure.

The lighting fixture 100 may also include a laser emitter 211. The laser emitter 211 is operable to emit a laser beam that may be used to assist with orienting the lighting fixture 100. For example, a direction of the beam emitted by the laser emitter 211 may generally correspond the direction of light emitted by the LED system 120. Thus, an installer may operate the laser emitter 211 and utilize the beam emitted by the laser emitter 211 to position and/or orient the lighting fixture 100 towards a desired location. In such a manner, the LED system 120 may emit light in a desired direction after installation of the lighting fixture 100.

The housing 110 may enclose or contain the surge protector, the transformer, the driver, and/or other components. For instance, one or more of the surge protector, the transformer, the driver, and/or other components can be positioned within and/or attached to a driver casing 116 positioned at a rear portion 119 of housing 110. The driver casing 116 is illustrated as a two-piece enclosure, and each half of the driver casing 116 may enclose or contain a respective surge protector, transformer, driver, and/or other components. The driver casing 116 may also be removable from the housing 110, e.g., with one or more of a fastener, a screw, a bolt, a mounting boss, a docketing sleeve, a hole, a male/female mechanism, etc. that connects the driver casing 116 to a support body 140 within the housing 110. Thus, e.g., in a configuration in which the modules 122 are operable with a remote driver(s), the driver casing 116 may be omitted from the lighting fixture 100. In such a manner, the lighting fixture 100 may be selectively equipped with the driver casing 116. The lighting fixture 100 may be lighter, smaller and/or more economical when lighting fixture does not include the driver casing 116 or an integrated driver.

Figure 6:
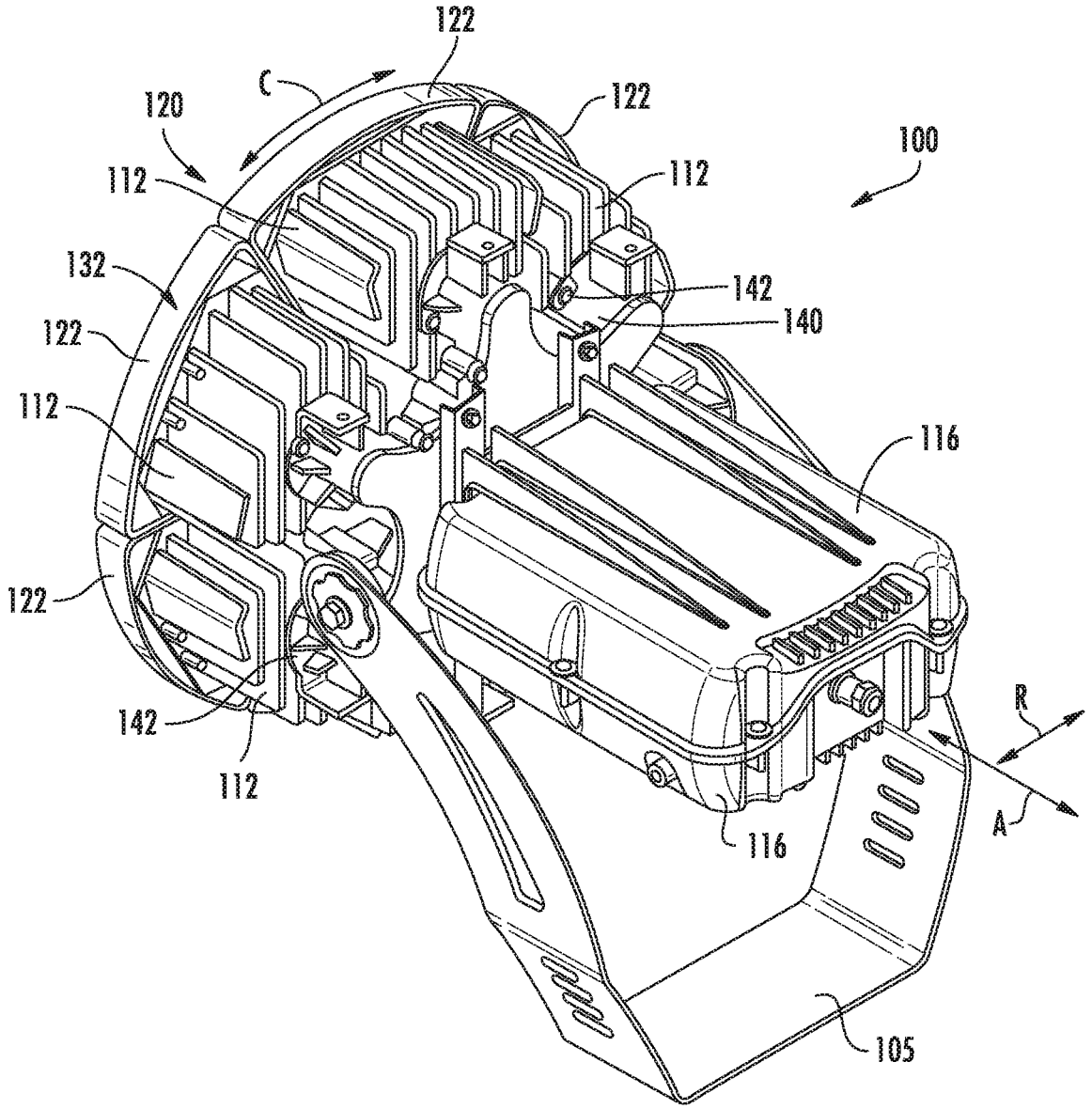
FIG. 6 depicts a rear, perspective view of certain components of the example lighting fixture of FIG. 3.
Figure 7:
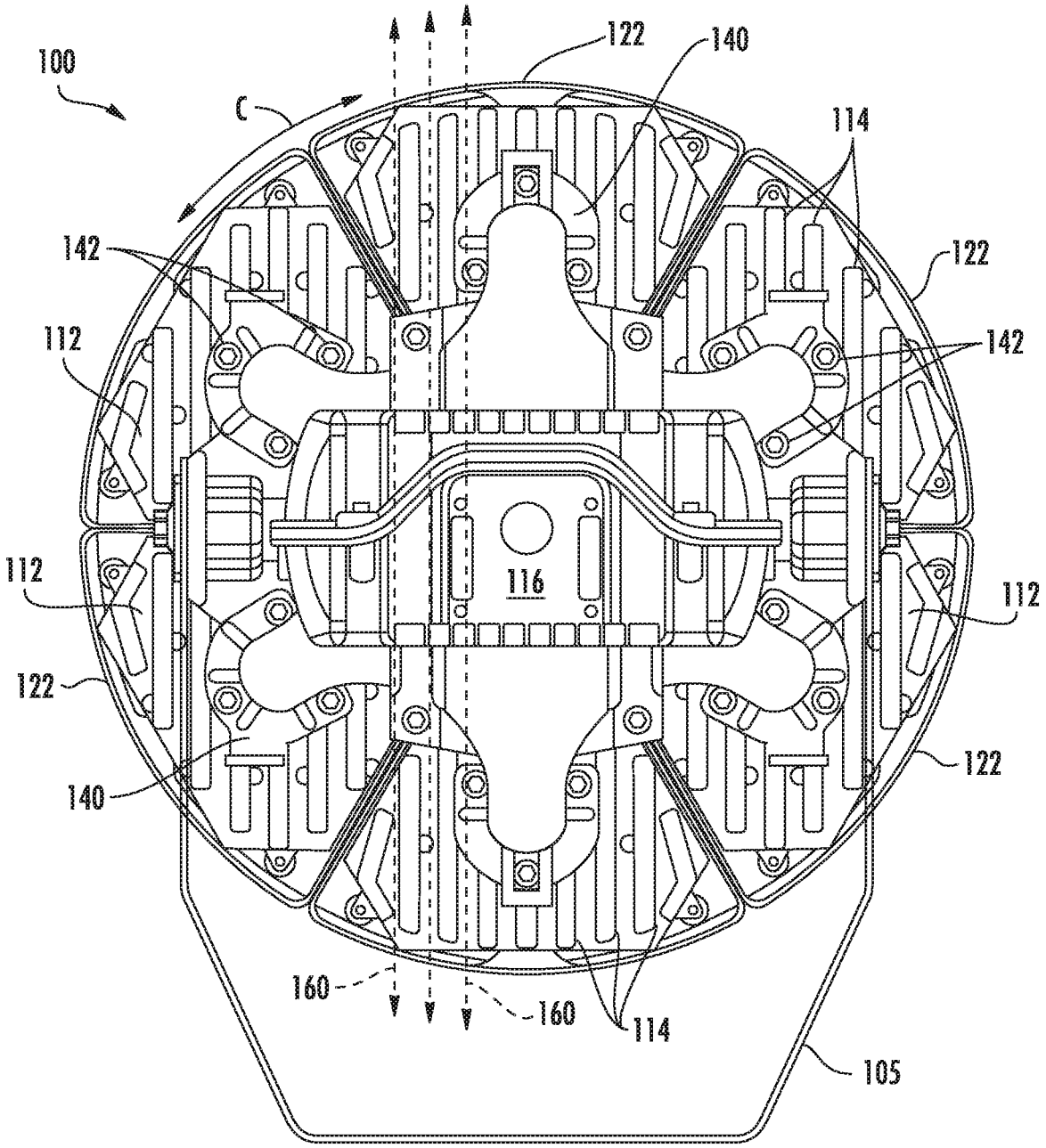
FIG. 7 depicts a rear, elevation view of the certain components of the example lighting fixture of FIG. 6.

Turning now to FIGS. 6 and 7, the lighting fixture 100 can include a plurality of heat sinks 112. Each heat sink 112 is located in the housing 110 and may be coupled or connected to a respective one of the modules 122. Thus, the heat sinks 112 may be separable from other components of the modules 122. The heat sinks 112 provide surface area for heat transfer with air flowing through the housing 110. For example, each heat sink 112 may have a plurality of fins 114 (FIGS. 11 and 12), and heat from LED devices 125 may be conducted or otherwise transferred to fins 114 of the heat sinks 112. Heat transfer between the fins 114 of the heat sinks 112 and ambient air within the housing 110 may assist cooling of the LED devices 125. The fins 114 may extend, e.g., along the axial direction A away from the front portion 118 of the housing 110 and/or towards the rear portion 119 of the housing 110.

As discussed in greater detail below, the lighting fixture 100 includes features for mounting a desired number of the modules 122 within the housing 110. For example, the lighting fixture 100 may be equipped with a greater number of modules 122 in certain lighting scenarios, and the lighting fixture 100 may be equipped with a lesser number of modules 122 in other lighting scenarios. Thus, the number of modules 122 installed within housing 110 may be selected by a manufacturer and/or user of the lighting fixture 100. In such a manner, a common housing 110 can contain various numbers of the modules 122 depending upon the desired light output.

Figure 5:
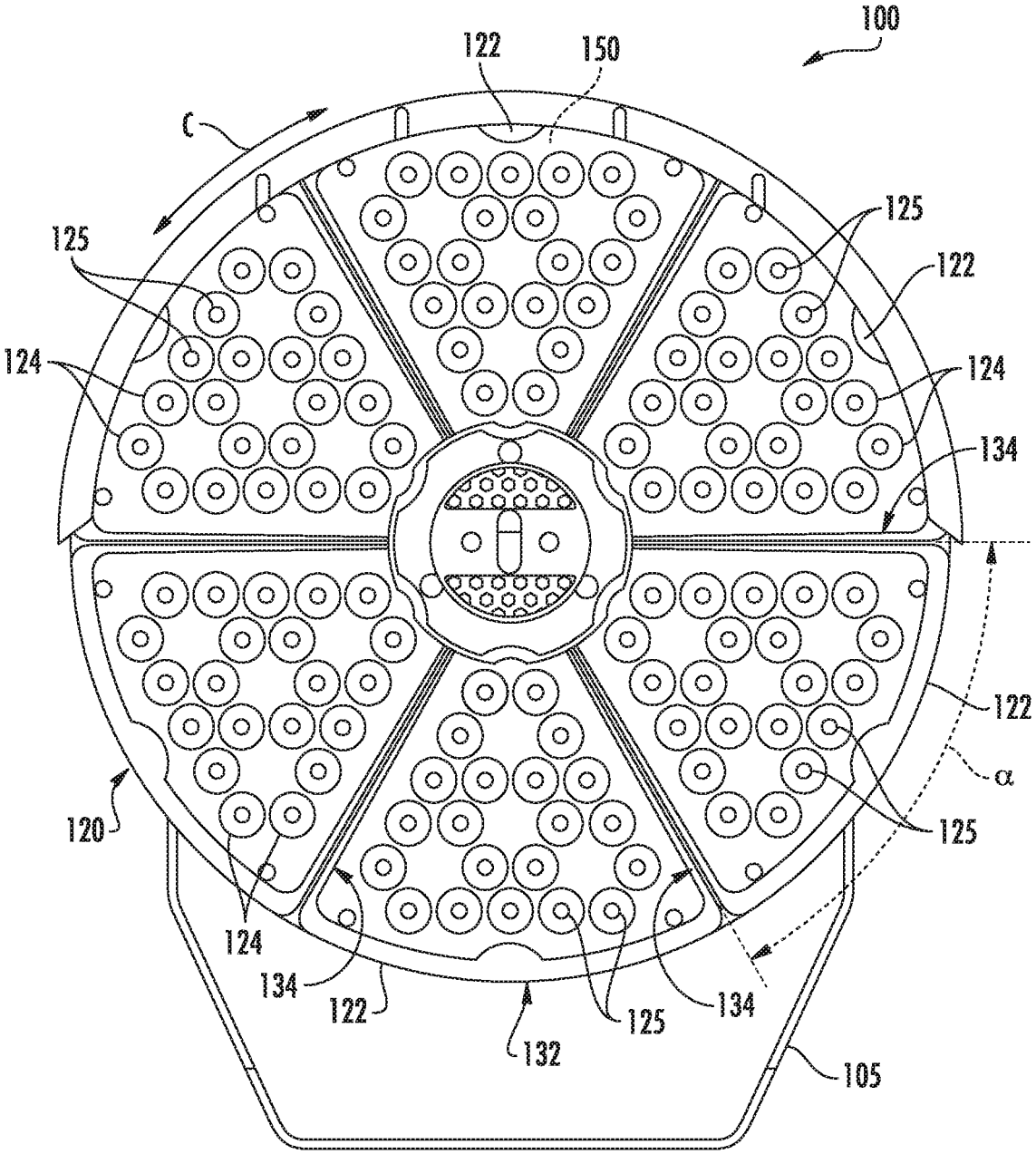
FIG. 5 depicts a front, elevation view of the example lighting fixture.

As may be seen in FIGS. 1 through 5, the lighting fixture 100 defines an axial direction A, a radial direction R and a circumferential direction C. The housing 110 extends between the front portion 118 and the rear portion 119, e.g., along the axial direction A. Thus, front and rear portions 118, 119 of housing 110 may be positioned opposite each other, e.g., along the axial direction A, on housing 110. The modules 122 are positioned at the front portion 118 of the housing 110. Turning to FIG. 5, the modules 122 may be distributed, e.g., along the circumferential direction C. Thus, e.g., modules 122 may be distributed in an arcuate or circular pattern. In the example embodiment shown in FIG. 5, the lighting fixture 100 includes six modules 122 that collectively extend three hundred and sixty degrees along the circumferential direction C and form a circular pattern. It will be understood that, in alternative example embodiments, one or more of the six modules 122 shown in FIG. 5 may be omitted from the lighting fixture 100. As discussed in greater detail below, the void or slot left by any omitted the module(s) 122 may be filled with a spacer module or plug 150. Accordingly, each module 122 is independently mountable and/or removable in the housing 110. In such a manner, a number of the modules 122 may be selectable, e.g., by a manufacturer or user of the lighting fixture 100, to suit a particular lighting scenario.

The modules 122 may include any suitable number of modules. For example, the modules 122 may include no less than two modules and no greater than twelve modules. Thus, the number of modules 122 within a housing may vary between two to twelve modules depending upon the particular lighting scenario. In the particular example embodiment shown in FIG. 5, the housing 110 may be sized for receiving no more than six modules 122. Thus, e.g., the number of modules 122 within the housing 110 may vary between two, three, four, five and six modules depending upon the particular lighting scenario. In particular examples, six modules 122 may be positioned within the housing 110 in one lighting scenario, three modules 122 may be positioned within the housing 110 in another lighting scenario, etc. In such a manner, the number of modules 122 may be selected to correspond to the particular lighting scenario.

The modules 122 may all have a common size and/or shape. Thus, the modules 122 may be interchangeable with one another. For example, as may be seen in FIGS. 5 and 8 through 10, the modules 122 may be wedge shaped. In particular, each module 122 may have an inner edge 130 and an outer edge 132. As shown in FIGS. 5 and 10, the inner and outer edges 130, 132 of the module 122 may be spaced from each other along the radial direction R. The inner and outer edges 130, 132 of the module 122 may be positioned opposite each other along the radial direction R on the module 122. As shown in FIG. 9, the inner edge 130 of the module 122 may face a center of the LED system 120, and the outer edge 132 of the module 122 may face away from the center of the LED system 120. Thus, the inner edge 130 of the module 122 may be positioned closer to the center of the LED system 120 than the outer edge 132 of the module 122. The inner edge 130 of the module 122 may also be disposed proximate a central axis X of the housing 110, e.g., that extends through the center of the LED system 120. A width W of the module 122, e.g., along the circumferential direction C, may taper or decrease from the outer edge 132 to the inner edge 130 of the module 122. Thus, the module 122 may be narrower along the circumferential direction C at or adjacent the center of the LED system 120 and wider circumferential direction C away from the center of the LED system 120, e.g., such that module 122 tapers along the radial direction R. The module 122 may also have a pair of opposing side edges 134. Side edges 134 of the module 122 may be spaced from each other, e.g., along the circumferential direction C. Thus, the side edges 134 of the module 122 may be positioned opposite each other along the circumferential direction C on the module 122. The side edges 134 of the module 122 may extend, e.g., linearly, along the radial direction R between the inner and outer edges 130, 132 of the module 122. Collectively, the inner edge 130, the outer edge 132 and the side edges 134 of the module 122 may form a wedge shaped perimeter of module, e.g., in a plane that is perpendicular to the axial direction A. When modules 122 are wedge shaped and positioned adjacent one another, the modules 122 may collectively form a circular or arcuate pattern within the housing 110. In particular, the side edges 134 of adjacent modules 122 may be positioned adjacent and/or contact each other and to form the circular or arcuate pattern within the housing 110, as shown in FIG. 5.

As shown in FIG. 5, the side edges 134 of the module 122 may define an angle α between each other, e.g., in a plane that is perpendicular to the axial direction A. The angle α may be any suitable angle. For example, the angle α between the side edges 134 may be no greater than one hundred and twenty degrees (120°) and no less than thirty degrees (30°). As another example, the angle α between the side edges 134 may be no greater than ninety degrees (90°) and no less than forty-five degrees (45°). As a particular example, the angle α between the side edges 134 may be about sixty degrees (60°). Such angling between the side edges 134 may provide the module 122 with a suitable wedge shape for collectively forming an arcuate and/or circular pattern of the modules 122 at the front portion 118 of the housing 110.

Figure 13:
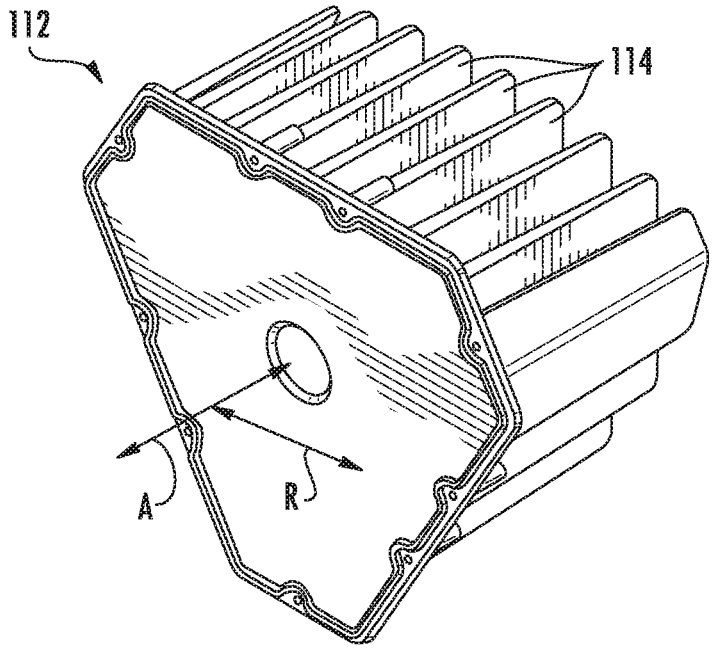
FIG. 13 depicts a front, perspective view of a heat sink of the example lighting fixture.

The modules 122 may all be manufactured with the same process in order to provide commonly sized and/or interchangeable modules 122. In addition, turning to FIGS. 13 and 14, all the heat sinks 112 may be commonly shaped or sized. Thus, e.g., the heat sinks 112 may all be formed with a common casting process or with a commonly sized mold. The heat sinks 112 may be formed of or with any suitable cast metal, such as aluminum, steel, etc. It will be understood that modules 122 may have a different arrangement of the LED devices 125 and/or the optics 124 to provide a desired light distribution from each module 122 and still be commonly sized as used herein.

Various mechanisms may be used to attach or mount modules 122 within the housing 110. For example, the modules 122 may be fastened, snap-fit, adhered, etc. within the housing 110. As shown in FIGS. 6 and 7, the lighting fixture 100 may include a support plate or body 140. The support body 140 may be positioned within and enclosed by housing 110, and modules 122 may be mounted to the support body 140. Thus, the support body 140 may provide a shared structure for mounting and/or bearing all of the modules 122 and/or plugs 150 within the housing 110. As discussed above, the modules 122 may be fastened, snap-fit, adhered, etc. to the support body 140 within the housing 110. As a particular example, the fasteners 142 may extend through the support body 140 and into the modules 122 in order to mount the modules 122 to the support body 140. As shown in FIGS. 8 and 9, the fasteners 142 may extend through the support body 140 into the fins 114 on the heat sinks 112 to mount the modules 122 to the support body 140. The support body 140 may define a plurality of through-holes for the fasteners 142. The through-holes may be distributed in a pattern that provides a plurality of possible mounting locations for the modules 122 such that the modules 122 are suitably spaced and/or oriented when mounted to the support body 140. Thus, each module 122 may be mounted to the support body 140 at a respective location on the support body 140. In such a manner, the support body 140 may provide a convenient layout or guide for mounting the modules 122 within the housing 110.

Turning to FIGS. 7, 8 and 9, the fins 114 on the heat sinks 112 may all be vertically oriented, e.g., when the modules 122 are mounted on the support body 140. As shown in FIG. 5, each heat sink 112 may be inverted or flipped relative to adjacent the heat sinks 112, e.g., to allow commonly sized and shaped heat sinks 112 to provide the vertical flow paths 160. Thus, it will be understood that the modules 122 may be commonly shaped, e.g., except for the orientation of the heat sinks 112 on the modules 122. With the fins 114 all vertically oriented, a plurality of vertical air flow paths 160 may be defined within the heat sinks 112. Vertical air flow paths 160 may facilitate cooling air flow through the heat sinks 112. For example, heated air may flow upwardly along the vertical air flow paths 160 between the fins 114. In particular, as warmer air flows upwardly within vertical air flow paths 160, cooler air may be drawn into vertical air flow paths 160. Thus, the vertically orienting fins 114 of the heat sinks 112 may assist with improving cooling convection air flow through the heat sinks 112.

As shown in FIGS. 3, 4, 8 and 9, the housing 110 may include a grill 113. To provide air flow to the heat sinks 112, the grill 113 may extend around the heat sinks 112 along the circumferential direction C on the housing 110, and the grill 113 may also be aligned with the heat sinks 112 along the radial direction R. Thus, e.g., the grill 113 may be positioned coplanar with the heat sinks 112, e.g., in a plane that is perpendicular to the axial direction A such that the plane intersects both the grill 113 and the heat sinks 112. A length of the grill 113, e.g., along the axial direction A, may also be about equal to a length of the fins 114 of the heat sinks 112, e.g., along the axial direction A. The grill 113 can facilitate cooling air flow into and out of the housing 110. For example, the grill 113 may be perforated such that air may flow through the housing 110 at the grill 113 to and/or from the heat sinks 112. In particular, cooler air may flow through the grill 113 into the housing 110 below the heat sinks 112, and warmer air may flow through the grill 113 out of the housing 110 above the heat sinks 112.

As discussed above, the lighting fixture 100 may include at least one spacer module or plug 150. When less than a maximum number of modules 122 is positioned within the housing 110, e.g., mounted on the support body 140, a respective plug 150 may be positioned at a location of each omitted module 122 within the housing 110. Thus, the plug 150 may replace each omitted module 122 within the housing 110. The plug 150 may be commonly sized to modules 122 such that the plug 150 and the modules 122 are interchangeable. Thus, the plug 150 may have suitable holes for receiving the fasteners 142 at the support body 140 and/or may have a wedge shaped outer plate 152 that is positioned coplanar with the LED devices 125. The plug 150 may assist with improving an appearance of the lighting fixture 100 relative to not filling the void left by the omitted module 122. Thus, the plug 150 and the modules 122 may be distributed along the circumferential direction C at the front portion 118 of the housing 110, and the plug 150 and the modules 122 may cooperate to collectively form a face of the lighting fixture 100. For example, the plug 150 and the modules 122 may collectively extend three hundred and sixty degrees (360°) along the circumferential direction C at the front portion 118 of the housing 110. It will be understood that the plug 150 may have an outer appearance that is identical to one of the modules 122 as shown in FIG. 5, e.g., except that the plug 150 does not include the LED devices 125.

Figure 15:
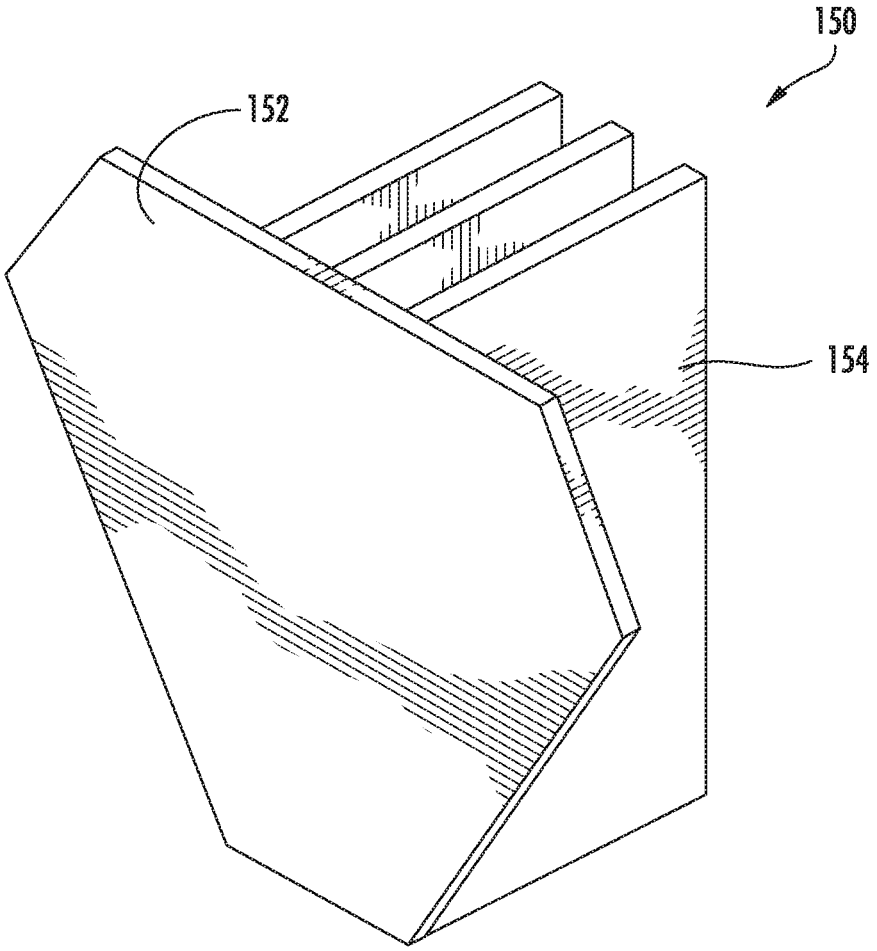
FIG. 15 depicts a front, perspective view of a spacer module or plug of the example lighting fixture.

FIG. 15 provides a perspective view of a plug 150 according to an exemplary embodiment of the present subject matter. As may be seen in FIG. 15, the plug 150 may include an outer plate 152 and a plurality of fins 154. The outer plate 152 may be commonly sized with an outer face of modules 122, and the fins 154 may provide a mounting location for the plug 150 in the manner described above for the fins 114 of the heat sink 112. The plug 150 may be formed of injection molded plastic or any other suitable material and need not include certain components of the modules 122, such as the optics 124, the LED devices 125 and/or a metallic heat sink 112. In other example embodiments, the plug 150 may include only the outer plate 152 and not the fins 154. In such example embodiments, the flat, outer plate 152 may be attached to adjacent modules 122 to secure the outer plate 152 to the adjacent modules 122.

Figure 17A:
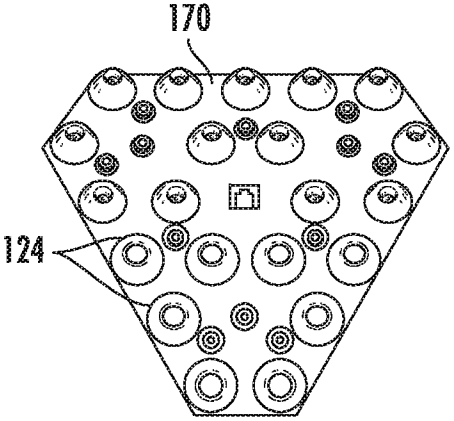
FIG. 17A is a front, perspective view of an inactive module support board of an example lighting fixture according to example embodiments of the present disclosure.
Figure 17B:
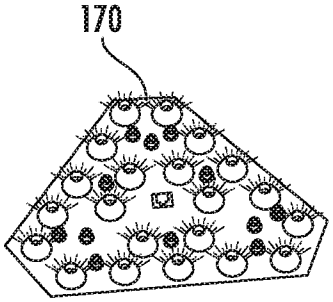
FIG. 17B is a front, perspective view of an active module support board of an example lighting fixture according to example embodiments of the present disclosure.

As may be seen in FIGS. 17A and 17B, the LED devices 125 can be mounted on a module support board 170. In some embodiments, the module support board 170 is a printed circuit board (PCB). In some embodiments, the module support board 170 is an LED board. The LED devices 125 can be configured to emit visible light because of movement of electrons between p-type and n-type semiconductor materials. The LED devices 125 can have any suitable size, color, color temperature, etc. for the desired light applications. In some embodiments, the plurality of LED devices are selected from color temperatures of 3000K, 4000K, 5000K and other suitable color temperatures, however, the LEDs are not restricted to any particular color temperature. In some embodiments, the LED devices 125 include subgroups each having a different set of color temperatures. As shown in FIG. 17A, the 21 LEDs in the plurality of LED devices are in an "off" (inactive state) condition. As shown in FIG. 17B, the 21 LEDs in the plurality of LED devices are in an "on" (active state) condition suitable for illumination purposes.

Figure 18A:
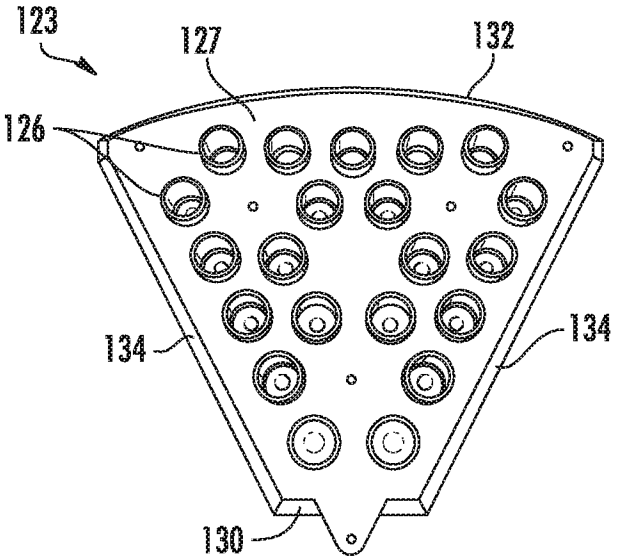
FIG. 18A is a front, perspective view of an inactive light engine module of an example lighting fixture according to example embodiments of the present disclosure.
Figure 18B:
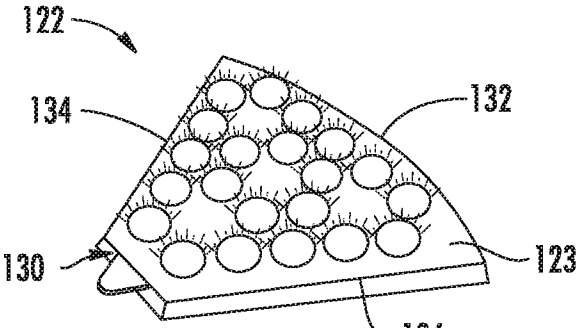
FIG. 18B is a front, perspective view of an active light engine module of an example lighting fixture according to example embodiments of the present disclosure.

As shown in FIGS. 18A and 18B, in some embodiments the bezel 123 attaches to the module support board 170 such that each of the plurality of glare reduction tubes 126 coaxially aligns with an optic 124 and an LED device 125. In some embodiments, the bezel 123 includes the plurality of glare reduction tubes 126, each glare reduction tube being optically coupled with one optic 124 and one LED device 125 such that each of the plurality of glare reduction tubes 126 enables light to pass from the one optic 124 and one LED device. As shown in FIG. 18A, the 21 LEDs included in the plurality of LED devices are in an "off" (inactive state) condition. As shown in FIG. 18B, the 21 LEDs included in the plurality of LED devices are in an "on" (active state) condition suitable for illumination purposes. FIGS. 17B and 18B are positioned side-by-side to help illustrate the reduction in glare between the LEDs 125 without the bezel 123 as shown in FIG. 17B and the LEDs with the bezel 123 as shown in FIG. 18B.

Figure 14:
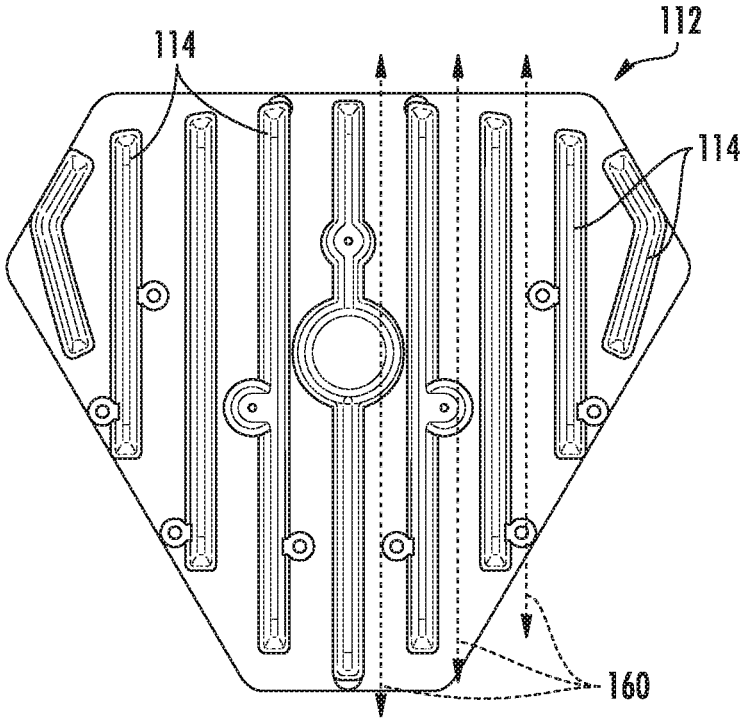
FIG. 14 depicts a rear, elevation view of the heat sink of FIG. 13.
Figure 19:
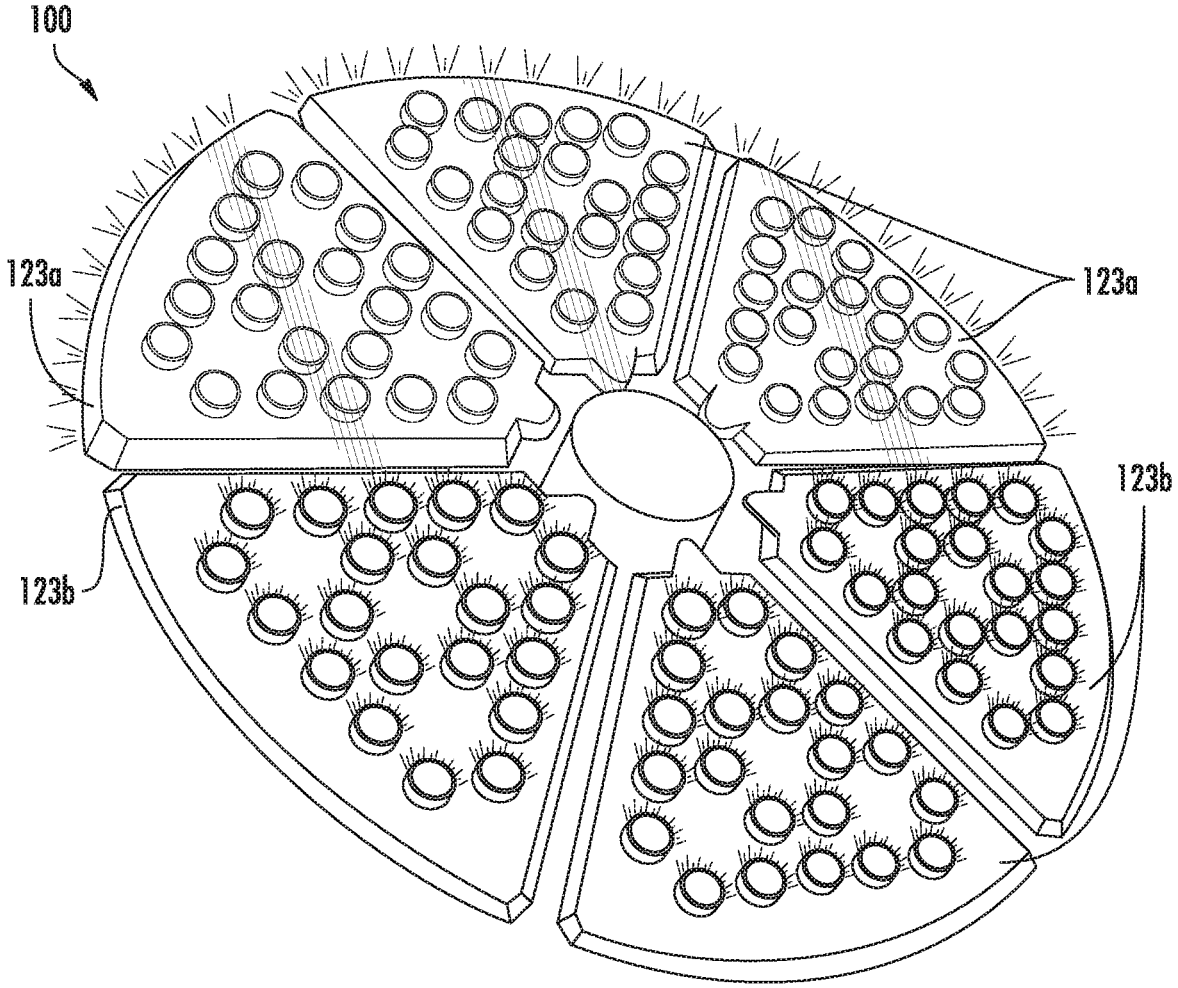
FIG. 19 is a front, perspective view of an active light engine module of an example lighting fixture according to example embodiments of the present disclosure.

Referring now to FIG. 19, a front, perspective view of active light engine modules of the lighting fixture 100 is provided according to the present disclosure is shown. For illustration purposes, the lighting fixture 100 includes three modules each having a translucent bezel 123*a* and three modules each having an opaque bezel 123*b*. In some embodiments, the translucent bezel 123*b* is white. In some embodiments, the opaque bezel 123*b* is black. In some embodiments, the opaque bezel 123*b* is formed from a black material. In some embodiments, the opaque bezel 123*b* is coated with a black material. As shown in FIG. 14, the glare reduction tubes in the bezels 123*a* and 123*b* are positioned over and aligned with active LEDs emitting light. Glare is reduced as described herein in both the translucent bezels 123*a* and the opaque bezels 123*b*.

Figure 20:
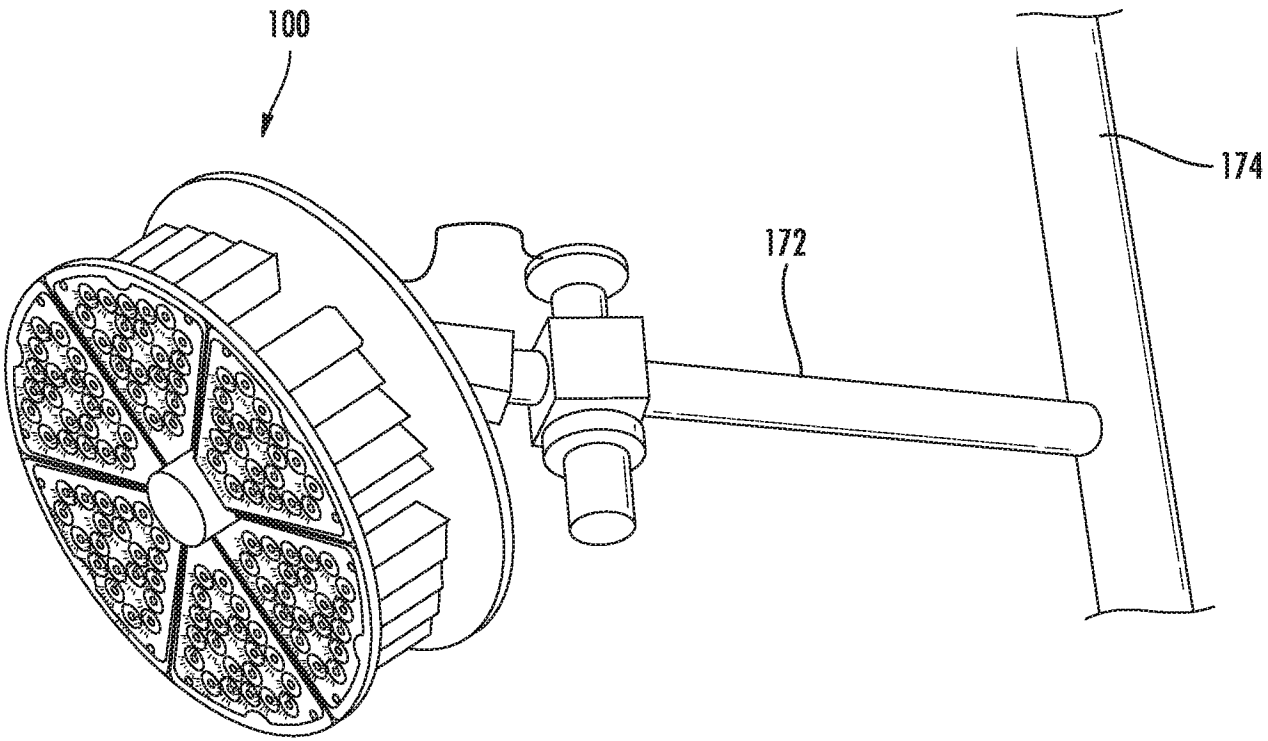
FIG. 20 is a view of an example lighting fixture mounted in an outdoor environment according to example embodiments of the present disclosure.

Referring now to FIG. 20, a photographic view of an illustrative embodiment of the lighting fixture 100 mounted in an outdoor environment according to the present disclosure is shown. The lighting fixture 100 is mounted via a connecting pole (arm) 172 to a support pole 174. The arm 172 is positioned approximately horizontal with respect to level ground and the support pole 174 is positioned approximately vertical with respect to level ground. The lighting fixture 100 is shown in an illuminated state.

Some embodiments herein describe a lighting fixture including a LED system, wherein the LED system includes at least one LED module having a plurality of LED devices and a bezel physically coupled to the LED system engine, the bezel having a plurality of glare reduction tubes formed therein, at least one glare reduction tube configured to be approximately coaxial with one LED device.

Some other embodiments herein described a lighting fixture including a LED system, wherein the LED system includes a plurality of LED modules each including a plurality of LED devices. The lighting fixture also includes a bezel physically coupled to the LED system, the bezel having a plurality of glare reduction tubed formed therein, at least one glare reduction tube configured to be approximately coaxial with one LED device and an optic, the optic configured to be approximately coaxial and optically coupled between the at least one glare reduction tube and the one LED device.

Still some other embodiments herein describe a lighting fixture including a LED system, wherein the LED system includes a plurality of LED modules each including a plurality of LED devices and a plurality of plugs, wherein the plurality of LED modules and plurality of plugs are interspersed and arranged in a ring. The lighting fixture also includes a bezel physically coupled to the LED system, the bezel having a plurality of glare reduction tubes formed therein, at least one glare reduction tube configured to be approximately coaxial with one LED device, and an optic, the optic configured to be approximately coaxial and optically coupled between the at least one glare reduction tube and the one LED device.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A lighting fixture defining an axial direction, a circumferential direction and a radial direction, the lighting fixture comprising:

a housing defining a cavity;

a single support body positioned within the cavity defined by the housing; and a plurality of modules, each of the plurality of modules comprising plurality of light emitting diodes, each of the plurality of modules independently mounted to the single support body, wherein the single support body includes a plurality of projections spaced apart from one another along the circumferential direction to provide a guide for mounting the plurality of modules to the single support body such that the plurality of modules are distributed along the circumferential direction.

2. The lighting fixture of claim 1, wherein each module of the plurality of modules has a common shape.

3. The lighting fixture of claim 1, wherein each module of the plurality of modules has an inner edge and an outer edge that are spaced along a radial direction, a width of each module of the plurality of modules along the circumferential direction tapering from the outer edge to the inner edge, the inner edge of each module of the plurality of modules positioned proximate a central axis of the housing.

4. The lighting fixture of claim 3, wherein each module of the plurality of modules has a pair of opposing side edges that extend along the radial direction between the inner edge and the outer edge, the pair of opposing side edges defining an angle, the angle between the pair of opposing side edges being no greater than one hundred and twenty degrees and no less than thirty degrees.

5. The lighting fixture of claim 1, wherein the plurality of modules comprises no less than two modules and no greater than twelve modules.

6. The lighting fixture of claim 5, wherein the plurality of modules is six modules.

7. The lighting fixture of claim 1, wherein each module of the plurality of modules comprises a heat sink with a plurality of fins that extend away from the front portion of the housing, the heat sink of each module of the plurality of modules mounted to the support body.

8. The lighting fixture of claim 7, wherein the fins on each heat sink are all vertically oriented such that a plurality of vertical air flow paths is defined within the heat sinks of the plurality of modules.

9. The lighting fixture of claim 7, wherein the heat sinks of the plurality of modules are all commonly shaped.

10. The lighting fixture of claim 7, wherein the housing comprises a grill that extends around the heat sinks of the plurality of modules along the circumferential direction.

11. The lighting fixture of claim 1, further comprising one or more drivers, the housing comprising a driver casing positioned at a rear portion of the housing, the one or more drivers positioned within the driver casing and operatively coupled to the plurality of modules.

12. The lighting fixture of claim 11, wherein the driver casing is a removable driver casing.

13. The lighting fixture of claim 11, wherein the plurality of modules is operable by one or more remote drivers, the one or more remote drivers positioned outside of the housing.

14. The lighting fixture of claim 1, further comprising at least one plug, the at least one plug and the plurality of modules distributed along the circumferential direction at the front portion of the housing.

15. The lighting fixture of claim 14, wherein the at least one plug and the plurality of modules collectively extend three hundred and sixty degrees along the circumferential direction at the front portion of the housing.

16. The lighting fixture of claim 14, wherein the at least one plug and the plurality of modules are interchangeable within the housing.

17. The lighting fixture of claim 1, wherein each module of the plurality of modules is independently removable from the housing.

* * * * *